US006928699B2

(12) United States Patent
Sawa

(10) Patent No.: US 6,928,699 B2
(45) Date of Patent: Aug. 16, 2005

(54) AUTOMATIC CLOSING DOOR HINGE, AUTOMATIC CLOSING DOOR MECHANISM, AND HINGE OF AUTOMATIC CLOSING DOOR MECHANISM

(75) Inventor: Kazu Sawa, Kitatsuru-gun (JP)

(73) Assignees: Masako Sawa, Yamanashi (JP); Kayoko Yamaguchi, Tokyo (JP)

( * ) Notice: Subject to any disclaimer, the term of this patent is extended or adjusted under 35 U.S.C. 154(b) by 0 days.

(21) Appl. No.: 10/451,792

(22) PCT Filed: Jan. 11, 2002

(86) PCT No.: PCT/JP02/00143

§ 371 (c)(1),
(2), (4) Date: Jul. 14, 2003

(87) PCT Pub. No.: WO02/055821

PCT Pub. Date: Jul. 18, 2002

(65) Prior Publication Data

US 2004/0068833 A1 Apr. 15, 2004

(30) Foreign Application Priority Data

Jan. 15, 2001 (JP) ..... 2001-006055
Apr. 9, 2001 (JP) ..... 2001-110416
Oct. 25, 2001 (JP) ..... 2001-327595

(51) Int. Cl.[7] ..... E05F 1/02; E05F 3/20

(52) U.S. Cl. ..... 16/312; 16/314; 16/318; 16/50; 16/54; 16/352; 16/303

(58) Field of Search ..... 16/312, 313, 314, 16/318, 50, 54, 352, 319, 303, 330

(56) References Cited

U.S. PATENT DOCUMENTS 1,200,538 A * 10/1916 Smith et al. ..... 16/303
2,118,950 A * 5/1938 Stannard ..... 16/54
2,164,358 A * 7/1939 Stannard ..... 16/54

(Continued)

FOREIGN PATENT DOCUMENTS

JP 51-44348 10/1976
JP 59-47794 11/1984
JP 08093313 A * 4/1996 ..... E05F/3/20
JP 09-184354 7/1997
JP 9-184354 7/1997
JP 10-88899 4/1998
JP 11-50738 2/1999
JP 2000-136669 5/2000
JP 2001032618 A * 2/2001 ..... E05F/3/14

OTHER PUBLICATIONS

Japanese Office Action dated Dec. 15, 2004 corresponding to Japanese Application 2001–110416, with a Concise Explanation in English.

* cited by examiner

*Primary Examiner*—Chuck Mah
(74) *Attorney, Agent, or Firm*—Armstrong, Kratz, Quintos, Hanson, & Brooks, LLP.

(57) ABSTRACT

An automatic closing door hinge, an automatic closing door mechanism, and a hinge of the automatic closing door mechanism, for smoothly opening a door or closing, with damping, a door. For example, an automatic door closing mechanism has a hinge having a pair of wing plates one of which has a cylinder in a circular cylindrical form received therein a piston, the other wing plate fixing an upper portion of an operation rod engaged with the piston, the piston being to be advanced and retracted through the operation rod associatively with a rotation of the other wing plate. The automatic closing door mechanism comprises a cam formed on the piston. An engaging part provided in the operation rod and movable in the cam. The cam and the engaging part engaging between the piston and the operation rod. A sphere arranged in a recess formed in an outer surface of the piston. A recess groove formed lengthwise in the cylinder. The sphere rolls along the recess groove, to allow the piston to slide within the cylinder. Impact upon door closing is to be damped by an action of air cushioning within the cylinder due to a return movement of the piston.

25 Claims, 14 Drawing Sheets

U.S. PATENT DOCUMENTS 2,222,965 A * 11/1940 Voelkel ..... 16/312
4,100,646 A * 7/1978 Schubeis ..... 16/54
4,391,020 A * 7/1983 Hsu ..... 16/314
4,485,522 A * 12/1984 Chen ..... 16/54
4,788,746 A * 12/1988 Idler ..... 16/297
4,829,628 A * 5/1989 Vuksic ..... 16/54
5,383,253 A * 1/1995 Lin ..... 16/54
5,419,013 A * 5/1995 Hsiao ..... 16/319
6,205,619 B1 * 3/2001 Jang ..... 16/352

(a)

(b)

(a)

(b)

(a)

(b)

(a)

(b)

(a)

(b)

(a)

(b)

AUTOMATIC CLOSING DOOR HINGE, AUTOMATIC CLOSING DOOR MECHANISM, AND HINGE OF AUTOMATIC CLOSING DOOR MECHANISM

BACKGROUND OF THE INVENTION

1. Field of the Invention

This invention relates to an automatic closing door hinge, an automatic closing door mechanism, and a hinge of the automatic closing door mechanism, such as a hinge for use in an opening-and-closing door including, for example, an entrance door.

2. Description of the Related Art

Conventionally, there is known a hinge and the like, for use in an opening-and-closing door including the entrance door, having automatic closing door means for automatically rotating an opening-and-closing door, upon opened, in a direction toward closing the door, and damping means for moderating an impact during closing the door. The automatic closing door means in many cases utilizes a restoration force of a coiled spring while the damping means frequently uses a hydraulic piston cylinder. Recently, there is a proposal of damping making use of air.

JP-A-9-184354 discloses a hinge structure with a damper having the following structure. Namely, in a hinge slidably coupling between cylindrical joints of leaf plates at an outer peripheral surface of a shaft, when a first leaf plate is rotated in one direction, a shaft moves axially through cam means formed between a first cylindrical joint and the shaft, to compress a spring incorporated in the cylindrical joint and expel the air within the air chamber closed by a valve device in the cylindrical joint. Furthermore, when the rotational force given to the first leaf plate is released, a restoration force of the spring moves the shaft in the other direction. By moving the shaft, the first leaf plate is rotated in the other direction through the cam means. Simultaneously, air is sucked at low speed in the air chamber through the valve device, thereby restoring the spring at low speed.

Meanwhile, JP-A-11-050738 discloses a hinge having a helical cam provided integral with a rotary shaft urged by a torsion coiled spring, to provide a piston integral with the opposed helical cam urged by a spring. The cylinder part is provided with a fine hole, to provide a damper function by a resistance of the air passing through it or by using a spring urging the cam having a piston part instead of using a torsion coiled spring, thereby providing both rotational force and damper functions.

Meanwhile, JP-A-2000-136669 discloses an automatic closing door mechanism having a pair of wing plates constituting a hinge one of which is provided with a cylinder in a circular cylindrical form, the cylinder having therein a piston to advance and retract associatively with a rotation of the other wing plate. The cylinder accommodates therein a compression coiled spring to be compressed by an advancement of the piston upon opening the door. In association with a return motion of the piston due to a restoration force of the compression coiled spring, the other wing plate is rotated in a direction toward closing the door. Furthermore, impact is damped upon closing the door, by the action of air cushioning within the cylinder due to a return movement of the piston.

The above automatic closing door mechanism having a damping function utilizing air-cushioning action is simple in structure and to be manufactured easily at low cost, enabling size reduction and space saving. Furthermore, there is a merit of no possibility of oil leak possibly staining the surrounding.

SUMMARY OF THE INVENTION

However, the foregoing automatic closing door mechanism is not smooth in opening the door or in closing the door while damping, i.e. unsatisfactory as a product to be actually accepted by the customer. There is a desire for an automatic closing door mechanism capable, for example, of smoothly effecting a door opening operation or a closing operation with damping, while making use of a merit of an automatic closing door mechanism utilizing the action of air cushioning.

The present invention has been made in order to solve the foregoing problem. It is an object thereof to provide an automatic closing door hinge, an automatic closing door mechanism, and a hinge of the automatic closing door mechanism simple in structure, which can be manufactured easily at low cost and reduced in size and weight and saved in space, and further smoothly opening the door and closing the door with damped, for example, while making use of a merit of an automatic closing door mechanism utilizing the action of air cushioning freely from staining the surrounding due to oil leak or so.

An automatic closing door mechanism of the invention is an automatic closing door mechanism having a hinge having a pair of wing plates one of which has a cylinder in a circular cylindrical form received therein a piston, the other wing plate fixing an upper portion of an operation rod engaged with the piston, the piston being to be advanced and retracted through the operation rod associatively with a rotation of the other wing plate, the automatic closing door mechanism comprising: a cam or a com groove formed on the piston; an engaging part provided in the operation rod and movable in the cam or cam groove, the cam and the engaging part engaging between the piston and the operation rod; a sphere arranged in a recess formed in an outer surface of the piston; and a recess groove formed lengthwise in the cylinder; whereby the sphere rolls along the recess groove, to allow the piston to slide within the cylinder, impact upon door closing is to be damped by an action of air cushioning within the cylinder due to a return movement of the piston.

In the hinge, the cylinder may structurally accommodate therein a compression coil spring to compress due to an action of the piston during door opening so that the other wing plate can be rotated in a direction toward door closing associatively with a return action of the piston due to a restoration force of the compression coiled spring. Meanwhile, the cam or cam groove is suitably formed correspondingly to a proper angle of 90 degrees or greater and 180 degrees or smaller, depending upon a door opening and closing required. By an engagement of the cam or cam groove with the engaging part or by a structure to roll the sphere in a recess in a piston outer surface along the recess groove, it is possible to make smooth and positive the associative operation between door opening-and-closing and piston advancement/retraction. Meanwhile, by forming a substantially horizontal stopper in a vicinity of a point the engaging part positions during door opening in the cam or cam groove, e.g. 90–120 degrees, 120–150 degrees or 150–180 degrees, it is possible to maintain a state of opening the door to a predetermined angle.

Furthermore, in the automatic closing door mechanism of the invention, the engaging part has a roller to rotate along the cam or cam groove. By rolling the roller along the cam or cam groove, associative operation is available further smoothly between the operation rod and the piston.

Furthermore, in the automatic closing door mechanism of the invention, the engaging part has a sphere arranged for rolling in a recess provided in an outer surface of the operation rod. By rolling the sphere in the recess in the operation-rod outer surface along the cam or cam groove, associative operation is available further smoothly between the operation rod and the piston.

Furthermore, in the automatic closing door mechanism of the invention, another hinge is comprised having a piston received in a cylinder in a circular cylindrical form provided in one of a pair of wing plates, the other wing plate fixing an upper portion of an operation rod engaged with the piston, the piston being to be advanced and retracted through the operation rod associatively with a rotation of the other wing plate, the other hinge having a compression coiled spring arranged within the cylinder and to be compressed by an operation of the piston during door opening, the other wing plate being to be rotated in association with a return movement of the piston due to a return force of the compression coiled spring. The other hinge may also structurally accommodate in such a manner that impact upon door closing is to be damped by an action of air cushioning within the cylinder due to a return movement of the piston.

By separately providing a hinge having a role of automatic door closing function and a hinge having a role of damping function, it is possible to make a specialized structure depending upon each function, e.g. making a structure of hinge that spring force adjustment or spring exchange is easy and at will, realizing a moderate damping by flowing much air through the cylinder of a hinge having a role of damping function, or so. It is possible to obtain a smooth, preferred automatic closing door mechanism and a damping function thereof.

Also, an automatic closing door mechanism having a hinge having a pair of wing plates one of which has a cylinder in a circular cylindrical form received therein a piston, the other wing plate fixing an upper portion of an operation rod engaged with the piston, the piston being to be advanced and retracted through the operation rod associatively with a rotation of the other wing plate, the automatic closing door mechanism comprising: a female thread formed on the piston; a male thread formed on the operation rod, the female and male threads engaging between the piston and the operation rod; a sphere arranged in a recess formed in an outer surface of the piston; a recess groove formed lengthwise in the cylinder, the sphere rolling along the recess groove, to allow the piston to slide within the cylinder; and a compression coiled spring arranged within the cylinder and to be compressed by an operation of the piston during door opening, the other wing plate being rotated in a direction toward door closing associatively with a return movement of the piston due to a restoration force of the compression coiled spring; whereby impact upon door closing is to be damped by an action of air cushioning within the cylinder due to a return movement of the piston.

By an engagement between female and male threads, it is possible to make smooth and positive an associative motion between a door opening-and-closing and a piston advancement-and-retraction. In case to form female and male threads by multi-stripped threads, e.g. 8-stripped thread, the associative motion between a door opening-and-closing and a piston advancement-and-retraction can be suitably made further positively and smoothly.

Furthermore, in the automatic closing door mechanism of the invention, a flowing-out speed of air from the cylinder is lower than a flowing-in speed of air to the cylinder, wherein provided is valve means capable of adjusting the flowing-out speed of air. By using valve means capable of adjusting a flowing-out speed of air, it is possible to realize a door closing operation with a desired speed for smoothness. Adjustment is facilitated.

Also, although the invention can use a proper material for the required component parts of the hinge, the use of a resin molded product having a required strength as a required component parts can suitably reduce the weight.

Also, an automatic closing door mechanism having a damping function has a hinge comprising: a pair of wing plates; a piston arranged within a cylinder provided in one of the wing plates; an operation rod fixed at a substantially upper portion by the other wing plate, a substantially lower portion of the operation rod being arranged within the cylinder; a cam groove having a slant region formed in an outer periphery of the substantially lower portion of the operation rod; and a sphere arranged for rolling in a predetermined position of the piston and protruding in an inner periphery; whereby the piston advances and retracts correspondingly to a movement of the sphere relative to the slant region of the cam groove, impact being to be damped by an action of air cushioning within the cylinder due to a return movement of the piston during door closing.

For example, in the case that the piston is formed with a cam groove and engaged with the operation rod, the piston is reduced in wall thickness or the piston or the like is reduced in strength. On the contrary, the foregoing hinge or automatic closing door mechanism has a cam groove formed in the operation rod to be engaged with the sphere of the piston, making it possible to further improve the strength or durability of the piston and engaging mechanism of cam groove and sphere. Also, the cam groove is formed in the operation rod and the piston is formed with a penetration hole in a predetermined position or a recess in its inner wall, to arrange a sphere in the penetration hole or recess thereby engaging between the sphere and the cam groove. Accordingly, because working or manufacture is simple, working or manufacture cost is reduced.

Furthermore, the automatic closing door mechanism having a damping function of the invention further comprises a spring arranged within the cylinder of the hinge and to be compressed by an operation of the piston during door opening, the other wing plate being to be rotated in a direction toward door closing associatively with a return movement of the piston due to a restoration force of the spring. The hinge, for damping an impact by air cushioning action, is provided with a spring, such as a compression coiled spring, to automatically rotate the wing plate in a direction toward door closing due to a restoration force thereof. Thus, provided is a single hinge having both an automatic closing door function and an impact damping function during door closing.

Also, the automatic closing door mechanism having a damping function of the invention further comprises another hinge having a pair of wing plates, a piston arranged within a cylinder provided in one of the wing plates, an operation rod fixed at a substantially upper portion by the other wing plate, the piston being engaged directly or indirectly with a substantially lower portion of the operation rod, the piston being to be advanced and retracted through the operation rod associatively with a rotation of the other wing plate, wherein a spring is arranged within the cylinder of the other hinge and to be compressed by an operation of the piston during door opening, the other wing plate being rotated in a direction toward door closing associatively with a return movement of the piston due to a restoration force of the spring. The other hinge than the hinge having an impact damping function during door closing due to air cushioning action is provided with a spring, such as a compression coiled spring, to automatically rotate the wing plate in a direction toward door closing due to a restoration force thereof. Thus, the other hinge is given a role of automatic door closing function. Incidentally, the automatic closing door mechanism may be a proper combination of a hinge having an automatic door closing function, a hinge having an impact damping function and a hinge having both an provided is a single hinge having both an automatic closing door function and an impact damping function.

Furthermore, in the automatic closing door mechanism having a damping function of the invention, the hinge or the other hinge is formed with a recess groove lengthwise in the cylinder, a second sphere being arranged for rolling in a predetermined position of the piston and protruding in an outer periphery, the second sphere rolling along the recess groove whereby the piston slides within the cylinder. For example, a penetration hole is formed in a predetermined position of the piston or a recess is formed in an inner peripheral surface thereof, to arrange a sphere in the penetration hole or recess so that the sphere can roll along the recess groove extending lengthwise in the cylinder thereby sliding the piston. This can smoothen the movement within the cylinder, making it possible to effecting smoothly a door opening operation or a closing operation with damping.

Furthermore, the automatic closing door mechanism having a damping function of the invention, the hinge or the other hinge is formed with a second recess groove connected to the recess groove circumferentially in a predetermined position of the cylinder, the piston being placed into a halt state in advancement and retraction by an engagement of the second sphere with the second recess groove. For example, a ring-formed recess groove is circumferentially provided in a predetermined position within the cylinder, to be connected to the lengthwise extending recess groove so that the sphere moving along the lengthwise extending recess groove is to engage with the ring-formed recess groove and move along the ring-formed recess groove. Due to this, movement, such as piston ascend, is stopped. On the other hand, the sphere goes out of engagement with the ring-formed recess groove and moves along the lengthwise extending recess groove, thereby starting a movement, such as piston descend. Due to this, piston movement can be controlled to a predetermined position. Furthermore, In the case that the sphere races in the circumferential recess groove, such as the ring-formed recess groove, a door opened state can be maintained. By rotating the door in the door closing direction and placing the sphere in a lengthwise recess groove position to thereby move it in the lengthwise recess groove, an automatic door closing operation can be effected.

Furthermore, in the automatic closing door mechanism having a damping function of the invention, the hinge or the other hinge has a slant in a slant region of the cam groove gradually moderating toward a direction of movement of the piston. By gradually moderating the slant of the cam groove or variably shorten the pitch as in the foregoing, adaptation is possible to the requirement for a strong force against compression as the spring, such as a compression coiled spring, is compressed. Balance is given between a force required in door opening and a force required in compressing the spring, thereby making it possible to make even the force required for door opening over the entire door opening operation. Accordingly, there is no need for a great force in proceeding for door opening. Door opening is possible generally evenly by a smaller force. Also, the variable pitch can enhance the air compression force within the cylinder.

Furthermore, in the automatic closing door mechanism having a damping function of the invention, the hinge or the other hinge has one end of the cam groove and a vicinity thereof formed substantially horizontal, a door opened state being to be maintained by positioning the sphere in a substantially horizontal region. By forming a substantially horizontal region in an upper portion of the cam groove, when the sphere positions at the substantially horizontal region, a door opened state can be maintained. By rotating the door in the door closing direction and moving the sphere from the substantially horizontal region of the cam groove to the slant region, an automatic door closing operation can be effected.

Furthermore, in the automatic closing door mechanism having a damping function of the invention, the hinge or the other hinge has two sets or more of the cam grooves and the spheres engaging the cam grooves. The cam groove and the sphere to engage the cam groove may be given one set. However, in case they are given at least two or more sets, e.g. three sets, four sets or the like, durability and strength can be improved. Furthermore, sphere or piston movement along the cam groove, opening and closing operation of the door, and the like can be suitably available with smoothness. Incidentally, where spheres are provided in the penetration holes or recesses formed in the piston, the penetration holes or recesses are increased in the number correspondingly.

Also, a hinge of the invention is a hinge for use in an automatic closing door mechanism having a damping function, the hinge comprising: a pair of wing plates; a piston arranged within a cylinder provided in one of the wing plates; an operation rod fixed at a substantially upper portion thereof by the other wing plate, a substantially lower portion of the operation rod being arranged within the cylinder; a cam groove having a slant region formed in an outer periphery of the substantially lower portion of the operation rod; a sphere arranged for rolling in a predetermined position of the piston and protruding in an inner periphery; whereby the piston advances and retracts correspondingly to a movement of the sphere relative to the slant region of the cam groove, impact being to be damped by an action of air cushioning within the cylinder due to a return movement of the piston during door closing.

Also, a hinge of the invention is a hinge for use in an automatic closing door mechanism having a damping function due to air cushioning action, the hinge comprising: a pair of wing plates; a piston arranged within a cylinder provided in one of the wing plates; an operation rod fixed at a substantially upper portion by the other wing plate, the piston being engaged directly or indirectly with a substantially lower portion of the operation rod, the piston being to be advanced and retracted through the operation rod associatively with a rotation of the other wing plate; and a sphere arranged for rolling in a predetermined position of the piston and protruding in an outer periphery; whereby the piston slides within the cylinder by rolling the sphere along a recess groove formed lengthwise in the cylinder.

Furthermore, the hinge of the invention further comprises a spring arranged within the cylinder and to be compressed by an operation of the piston during door opening, the other wing plate being to be rotated in a direction toward door closing associatively with a return movement of the piston due to a restoration force of the spring, wherein a second recess groove is formed connected to the recess groove circumferentially in a predetermined position of the cylinder, the piston being placed into a halt state in advancement and retraction by an engagement of the sphere with the second recess groove.

Also, a hinge of the invention is a hinge for use in an automatic closing door mechanism having a damping function due to air cushioning action, the hinge comprising: a pair of wing plates; a piston arranged within a cylinder provided in one of the wing plates; and an operation rod fixed at a substantially upper portion by the other wing plate, the piston being engaged directly or indirectly with a substantially lower portion of the operation rod, rotation of the other wing plate and advancement and retraction of the piston being associated through the operation rod; wherein the cylinder has a cross sectional form having at least one protrusions protruding from a circle. The cylinder cross sectional form may be circular similarly to the usual. It may be given substantially circular having at least one protrusion, e.g. one, two or three, wherein the protrusions is in a proper position in the cross sectional form. It may be polygon such as a quadrangle or hexagon, or in an elliptic form or the like.

Furthermore, in the hinge of the invention, at least one protrusions are provided along a lengthwise direction in the cylinder, a sphere arranged for rolling in a predetermined position of the piston and protruding in an outer periphery, the piston being to be slid within the cylinder by rolling the sphere along at least one of the protrusions. By using the protrusion in place of the recess groove for rolling the sphere lengthwise, there is no need to separately work a recess groove. In addition, the piston can be smoothened in movement within the cylinder.

Also, a movement transfer mechanism of the invention comprises: a rod; a cam groove having a slant region and formed in an outer periphery of the rod; a sphere arranged for rolling in a predetermined position of a cylindrical part and protruding in an inner periphery, the rod being inserted in the cylindrical part to thereby engaging between the sphere and the cam groove; wherein, by a movement of the sphere relative to the slant region of the cam groove, a rotation of the rod about an axis is converted into an advancement and retraction of the cylindrical part in an axial direction of rod thereby transferring a motion, or an advancement and retraction of the cylindrical part in an axial direction of rod is converted into a rotation about an axis of the rod thereby transferring a motion. The cylindrical part can be made in a bottomed cylindrical member or cylinder, e.g. a piston. Meanwhile, the sphere can be arranged in a predetermined position of the cylindrical part, by a scheme similar to the hinge of the invention.

Incidentally, the invention includes those one part of a particular matter of each invention disclosed in the description is suitably modified to one part or the entire of a particular matter of another invention disclosed in the description, those a particular matter of each invention is suitably added by one part or the entire of a particular matter of another invention, and those one part of a particular matter of each invention is suitable deleted of one part of a particular matter as required. For example, one part of a matter described as a particular matter of an automatic closing door mechanism having a damping function can be suitably one part of a particular matter of a hinge of the invention or one part of a particular matter of a motion transfer mechanism thereof.

Also, concerning the other feature than the feature of a cam groove and sphere to engage the cam groove of the invention, the invention includes those properly combined with another particular matter disclosed in the description. Also, concerning a direct or indirect engagement between a substantially lower portion of the operation rod and the piston, there are included, besides an engagement between a cam groove of the operation rod and a sphere provided on the piston, an engaging between a cam groove formed in the piston and an engaging part provided on the operation rod or a roller, and an engagement between a female thread formed on an inner periphery of the piston and a male thread formed in an outer periphery of the operation rod. Meanwhile, the engaging means of the piston, engaged with a cam groove of the operation rod and movable relative to the cam groove, can be made as engaging means of other than the sphere, e.g. a roller may be provided, as the engaging means, to protrude for rolling in a predetermined position of inner periphery of the piston.

Also, an automatic closing door hinge of the invention is an automatic closing door hinge having a pair of wing plates, a cylindrical member substantially in a cylindrical form arranged within a cylinder provided in one of the wing plates, an operation rod fixed at a substantially upper portion by the other wing plate, the cylindrical member being engaged directly or indirectly with a substantially lower portion of the operation rod, a rotation of the other wing plate and an ascend and descend of the cylindrical member being associated through the operation rod, and a spring arranged within the cylinder and to be compressed by an ascend of the cylindrical member during door opening thereby rotating the other wing plate in a direction toward door closing associatively with a descend of the cylindrical member due to a restoration force of the spring, the automatic closing door hinge characterized in that: an engaging part provided inward of the cylindrical member and substantially below the operation rod is directly or indirectly engaged with the cylindrical member, the cylindrical member when ascending to a predetermined height being released from the engagement with the engaging part and halts ascending, the cylindrical member positioned at the predetermined height being engaged with the engaging part whereby the cylindrical member commences descending due to a restoration force of the spring. Incidentally, the engagement between the engaging part and the cylindrical member is suitably configured within the scope of the gist of the invention.

Furthermore, in the automatic closing door hinge of the invention, the engaging part is in a substantially columnar form or substantially bottomed cylindrical form formed with a vertically extending recess groove, the cylindrical member being formed with a recess recessed in an inner peripheral surface or penetration hole, a sphere arranged for rolling in the recess or penetration hole being to engage with the recess groove thereby engaging between the engaging part and cylindrical member. The structure with an indirect engagement through the sphere is simple in structure and excellent in durability, making it possible to smoothen the door opening-and-closing operation. In the above of the engaging part, suitably provided a passage for the sphere released from engagement to roll in a circumferential direction.

Furthermore, in the automatic closing door hinge of the invention, the engaging part has an outer shape in plan view of a substantially columnar or substantially bottomed cylindrical form and formed with a fit groove vertically extending from a lower end in an inner surface of the cylindrical member, the engaging part and the cylindrical member is to be engaged by fitting between the engaging part and the fit groove. The structure of a direct engagement due to fitting between the engaging part and the fit groove is simple in structure and excellent in durability, making it possible to smoothen the door opening-and-closing operation. The engaging part in a plan view outer shape, if made in a form free of corners, e.g. generally elliptic, is suitably smoothened in releasing from and restoring an engagement between the cylindrical member and the engaging part.

Furthermore, in the automatic closing door hinge of the invention, the cylindrical member can form a substantially airtight space within the cylinder, impact being to be damped during door closing by an action of air cushioning within the cylinder due to a descend of the cylindrical member. By making an automatic closing door hinge for automatic door closing operation by a spring restoration force as a structure having an impact damping function due to air cushioning, a single hinge can be made which has the both of automatic door closing function and impact damping function.

Also, an automatic closing door mechanism of the invention comprises a first hinge structured with: a pair of wing plates; a cylindrical member arranged within a cylinder provided in one of the wing plates; an operation rod fixed at a substantially upper portion by the other wing plate, the cylindrical member being engaged directly or indirectly with a substantially lower portion of the operation rod, a rotation of the other wing plate and an ascend and descend of the cylindrical member being associated through the operation rod; a spring arranged within the cylinder and to be compressed by an ascend of the cylindrical member during door opening, the other wing plate being to be rotated in a direction toward door closing associatively with a descend of the cylindrical member due to a restoration force of the spring; and an engaging part provided inward of the cylindrical member and beneath the operation rod, the engaging part being to be directly or indirectly engaged with the cylindrical member, the cylindrical member when ascended to a predetermined height being released from the engagement of the engaging part and stopped ascending, the cylindrical member positioned in a predetermined height being engaged by the engaging part whereby the cylindrical member begins descending due to a restoration force of the spring; and a second hinge structured with: a pair of wing plates; a cylinder provided on one of the wing plates; a piston arranged within the cylinder; and an operation rod fixed at a substantially upper portion by the other wing plate, the piston being directly or indirectly engaged with a substantially lower portion of the operation rod; whereby a rotation of the other wing plate and an ascend and descend of the piston is associated through the operation rod, impact being to be damped during door closing by an action of air cushioning due to a descend of the piston.

Also, a hinge in an automatic closing door mechanism of the invention comprises: a pair of wing plates; a cylinder provided in one of the wing plates; a piston arranged within the cylinder; an operation rod fixed at a substantially upper portion by the other wing plate, the piston being directly or indirectly engaged with a substantially lower portion of the operation rod, a rotation of the other wing plate and an ascend and descend of the piston being associated through the operation rod, impact being to be damped during door closing by an action of air cushioning due to a descend of the piston; and a flow-out suppressing member provided outward of a narrowest portion of a flow-out passage of the cylinder. For example, at the lower end of the cylinder, provided is valve means having separately a flow-in passage of air and flow-out passage of air to and from the cylinder, to provide a flow-out suppressing member outward of a narrowest portion of the flow-out passage.

Furthermore, in the hinge in an automatic closing door mechanism of the invention, an O-ring is provided as the flow-out suppressing member at a gap of a screw thread screwed with the narrowest portion of the flow-out passage. The use of a gap of a screw thread screwed in the flow-out passage suitably enabling to adjust air flow-out amount to an optimal amount while suppressing it and eliminate the need to separately provide a flow-out passage. Meanwhile, the use of an O-ring in a lower part of the screw thread as a flow-out suppressing member suitably enables to adjust the air flow-out amount to a desired amount easily and positively by a simple structure.

Incidentally, the engagement between the operation rod and the cylindrical member or piston is suitably by a direct engagement due to screwing between a male thread on the operation rod and a female thread on a cylindrical member inner surface or piston inner surface, by forming a cam groove on an operation rod, cylindrical member or piston and an engaging member or protruding sphere on the corresponding cylindrical member, piston or operation rod so that direct or indirect engagement is provided by the cam groove and the engaging member or sphere, or so.

The hinge or mechanism for closing a door of the invention, because of the above structure, is simple in structure and to be manufactured easily at low cost, enabling weight reduction and space saving. Meanwhile, there is an effect that door opening operation or door closing operation with damping can be smoothly effected while making use of the merit of an automatic closing door mechanism utilizing air cushioning action, e.g. free from staining the surrounding due to oil leak.

Meanwhile, by the structure that the cylindrical member when ascending to a predetermined height is released from an engagement by the engaging part thereby stopping the cylindrical member from ascending and engaging the cylindrical member positioning at the predetermined height with the engaging part thereby starting the cylindrical member to descend due to a restoration force of the spring, the engagement can be released by a rotation of the door at a predetermined angle or greater thereby maintaining a door opened state. Furthermore, by providing the door rotation angle with a predetermined or less, the engagement can be restored to effect an automatic door closing operation.

Meanwhile, the foregoing structure can be realized by easy working. The smoothness in door opening or closing can be further improved. For example, by an engagement with the engaging part at the inner of the cylindrical member, it is possible to avoid a situation, e.g. cutting at a cylinder engagement point in the case anti-rotation engagement is made at an outward of the cylindrical member or piston. Thus, high degree of durability is provided.

Meanwhile, by providing a flow-out suppressing member at an outward of a narrowest portion of the flow-out passage of air from the cylinder, air flow-out amount can be positively suppressed to a predetermined amount, making possible to obtain a favorable air cushioning effect free from occurrence of blocking air. Also, by a provision at the outward, air flow-out amount can be easily adjusted to an optimal amount.

Meanwhile, in the invention, in the case of a structure to engage between the cam groove formed in the outer periphery of the operation rod and the penetration hole formed in the piston or sphere arranged in the recess, working or manufacture is easy as compared to the case of forming a female thread on the piston, e.g. it is satisfactory to work a piston part by making a cylinder and opening a hole therein. Also, because it is the sphere that is to move engaging with the cam groove, cam groove slant or pitch can be freely set.

Furthermore, the sphere movement along the cam groove is smooth with less frictional resistance, enabling the piston to advance and retract smoothly.

DESCRIPTION OF THE PREFERRED EMBODIMENTS

Now an automatic closing door hinge, an automatic closing door mechanism, and a hinge of the automatic closing door mechanism, according to the present invention will be explained by way of detailed embodiments thereof.

Figure 1:
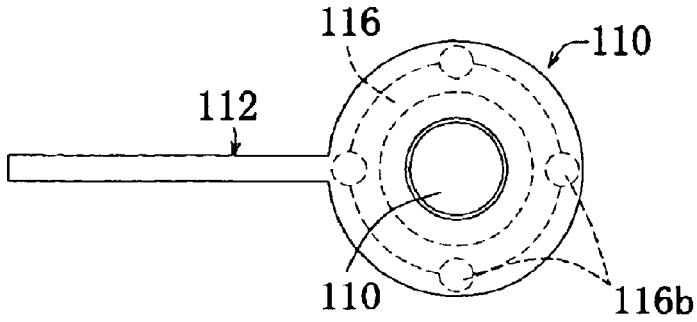
FIG. 1A is a plan view showing a hinge in a first example according to an automatic closing door mechanism in a first embodiment of the present invention.
FIG. 1B is a front view partly vertically broken away showing the hinge in the first example according to the automatic closing door mechanism in the first embodiment of the invention.
Figure 1:
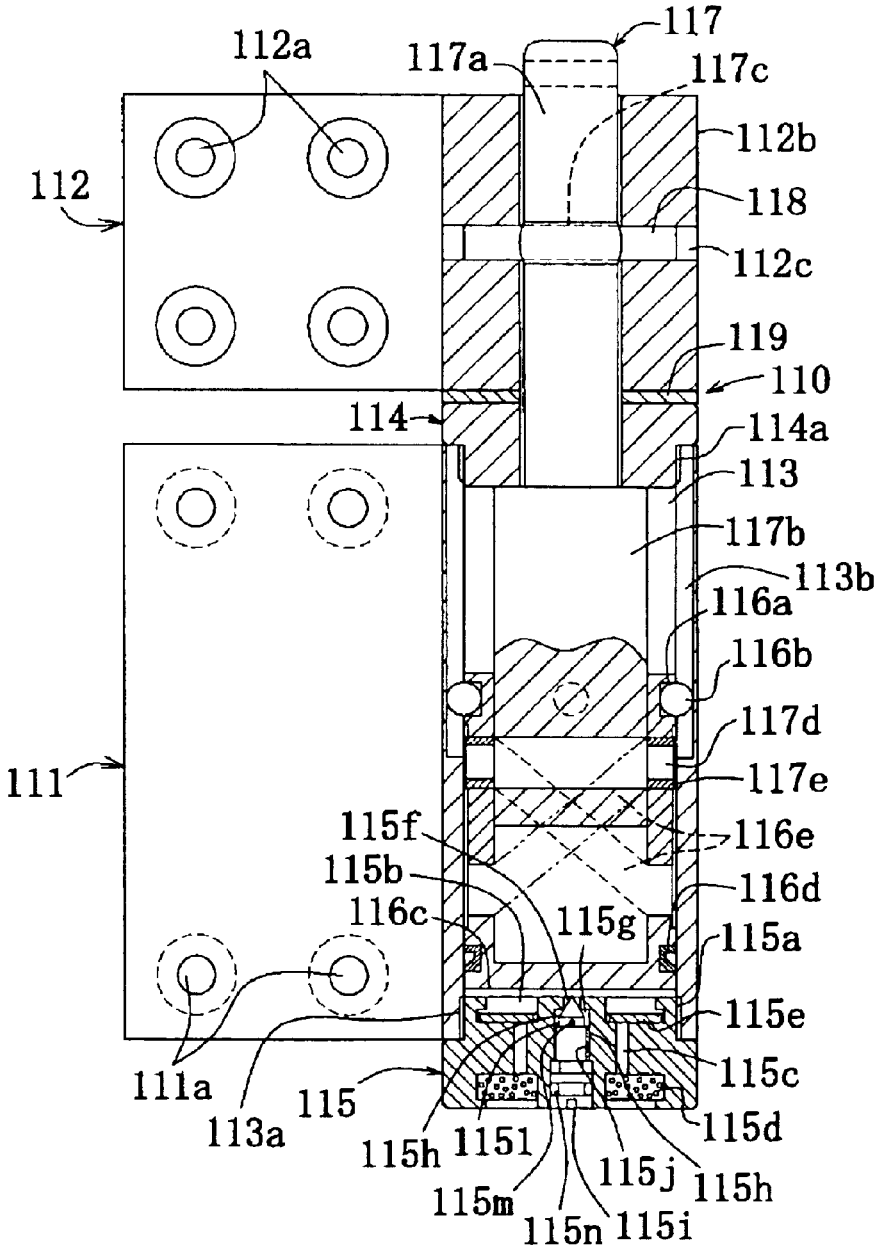
Figure 2:
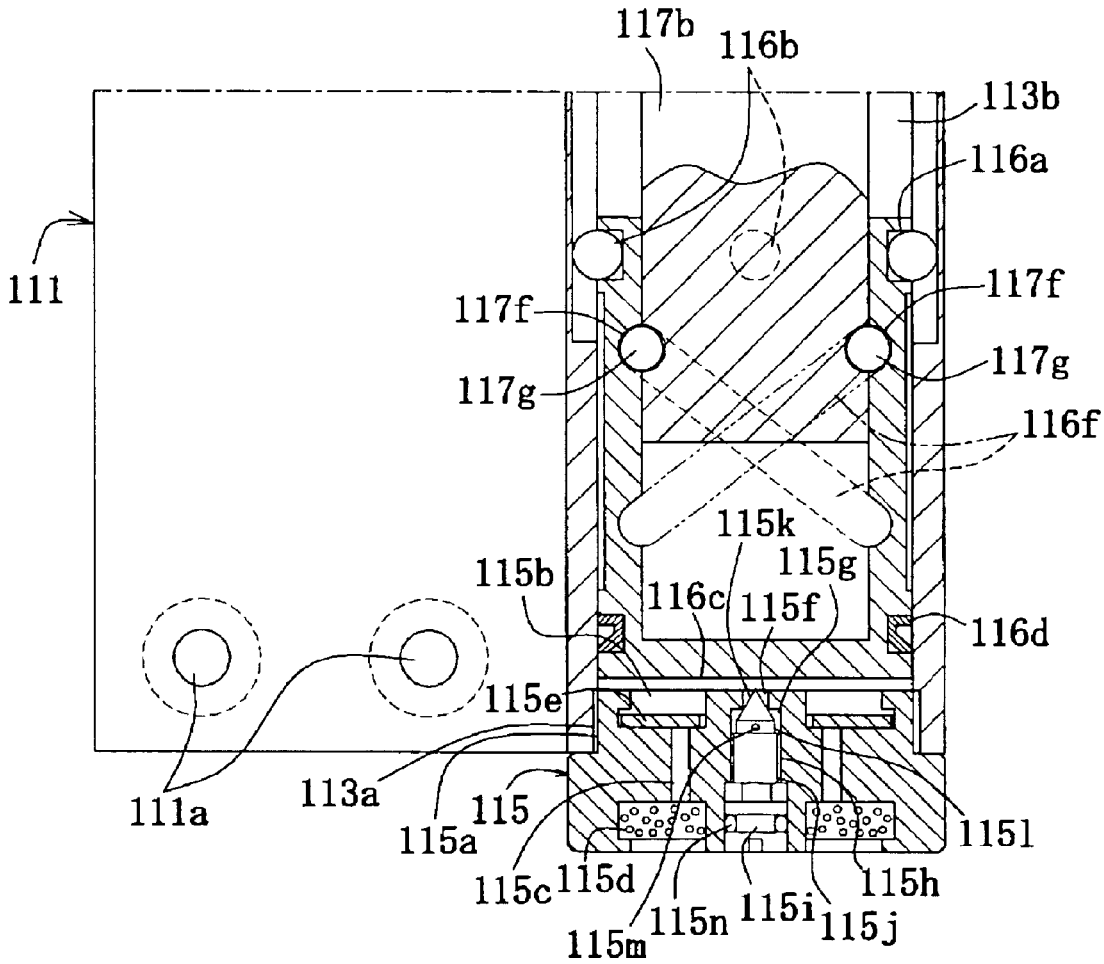
FIG. 2 is a fragmentary front view partly vertically broken away showing a modification to the hinge of the first example.

In the outset, explained is a first embodiment of the invention. In the first embodiment of the invention, a hinge 110 in a first example has a pair of one wing plate 111 and the other wing plate 112 that are in a pair formed of metal, plastic or the like, as shown in FIG. 1. By inserting flat head screws or the like through the mounting holes 111*a*, 112*a* formed in the wing plates 111, 112, one wing plate 111 can be attached to a doorframe or the like while the other wing plate 112 can be to an opening-and-closing door or the like.

The one wing plate 111 is integrally provided with a cylinder 113 in a circular cylindrical form. A female thread 113*a* is formed in a lower end of the cylinder 113 while a female thread (not shown) is similarly formed in an upper end of the cylinder 113. The cylinder 113 has, at its upper end, a cap 114 generally in a short cylindrical form having larger and smaller diameter portions. The male thread 114*a* formed in the outer surface of the smaller diameter portion of the cap 114 is screwed and fixed to the female thread in the cylinder upper end. The cylinder 113 has, at its lower end, a cap 115 generally in a short cylindrical form having smaller and larger diameter portions. The male thread 115*a* formed in the outer surface of the smaller diameter part of the cap 115 is screwed and fixed to the female thread 113*a*.

The cap 115 has a space 115*b* generally in a ring form provided in its upper end of the smaller diameter portion. Two air-intake ports 115*c*, 115*c*, communicating between the space 115*b* and the lower end of cap 115, are formed in a diameter of approximately 2 mm. At a lower end of the air-intake port 115*c*, a filter 115*d* of open-cell sponge or the like is arranged in order to prevent dusts from intruding. At an upper end of the air-intake port 115*c*, a valve plate 115*e* is rested which is to be slightly floated by flowing-in of air during airflow into the cylinder 113, and urged against the air-intake port 115*c* by the airflow during flowing-out of air.

In the center of the cap 115, a smaller diameter bore 115*f* and a larger diameter bore 115*g* are formed in communication. A male thread 115*j* of an adjusting bolt 115*i* is screwed in a female thread 115*h* formed in a side surface of the larger diameter bore 115*g*. The adjusting bolt 115*i* has a taper 115*k* formed at a tip thereof, to provide a smaller diameter portion 1151 below the taper 115*k*. An air discharge passage 115*m* generally in a T-form or L-form, communicating from the outer side surface of the smaller diameter portion 115*l* to the lower end of the adjusting bolt 115*i*, is formed in the adjusting bolt 115*i*. 115*n* is an O-ring fit in a lower part of the adjusting bolt 115*i*, in order to keep air tightness. The flowing velocity of an air, discharged to the outside of the cylinder 113 through the air discharge passage 115*m*, can be adjusted by adjusting the amount of screwing the adjusting bolt 115*i* and thereby adjusting the amount of a gap between the taper 115*k* and the smaller diameter portion 115*f*. Incidentally, the valve means is not limited to the foregoing structure, which admits air from the outside to the inside of the cylinder 113 and discharges air, while suppressing it, from the inside to the outside.

Within the cylinder 113, a piston 116 generally in a bottomed cylindrical form is arranged for sliding in a vertical direction. The piston 116 has generally cylindrical recess 116*a* formed in an outer surface nearly at an upper end thereof, at four points in this embodiment. Within the recesses 116*a*, spheres 116*b* made of steel or the like are arranged for rolling. On the other hand, four strips of recess grooves 113*b* are formed lengthwise in the inner wall of the cylinder 113. The sphere 116*b* is partially received in the recess 116*a* and in the recess groove 113*b*, i.e. the sphere 116*b* is allowed to roll along the recess groove 113*b* while being held in the recess 116*a*. Because the spheres 116*b* are fit in the recess grooves 113*b*, the piston 116 is prohibited from rotating circumferentially but allowed to vertically slide smoothly within the cylinder 113 owing to rolling of the spheres 116*b*.

On the outer surface nearly in the lower end of the piston 116, a packing 116*d* is fit circumferentially in order to keep air-tightness of the air admitted to the space within the cylinder 113 at between the lower surface 116*c* of piston 116 and the upper part of cap 115.

A pair of cam grooves or cams 116*e*, 116*e* are formed circumferentially extending from a generally upper region to a generally lower region of the piston 116, each of which comprises a slant surface and a generally horizontal surface as a stopper for the door in an opened state. The cam 116*e* is formed through a predetermined angle to cope with a rotation of the door through a predetermined angle of 180 degrees or smaller. The slant surface is formed at a predetermined circumferential angle so that a hereinafter-referred operating rod, at its engaging part, can move along the slant surface to thereby automatically effect a closing operation, in a state of door opening at an angle approximately 90 degrees or less. The horizontal surface is formed at a predetermined angle with respect to a circumferential direction so that the engaging part can be placed at a predetermined position in the horizontal surface to keep a door opening, in a state of door opening at an angle approximately 90 degrees or over. Incidentally, it is possible to employ a cam groove or cam not having a horizontal surface stopper.

An operation rod 117 is formed by a smaller diameter portion 117*a* generally in the upper half and a larger diameter portion 117*b* generally in the lower half. The smaller diameter portion 117*a* is inserted in a center of the cap 114 so that the top surface of the larger diameter portion 117*b* abuts against an underside of the cap 114. The smaller diameter portion 117*a* of the operation rod 117 is received in a cylinder 112*b* integrally formed on the other wing plate 112, and fixed by inserting or so an engaging pin 118 in a penetration hole 112*c* of the cylinder 112*b* and a penetration hole 117*c* of the smaller diameter portion 117*a*. Incidentally, 119 is a washer which lies between the one wing plate 111 and the other wing plate 112.

The operation rod 117 has, at its generally lower part, a pair of operation pins 117*d*, 117*d* projecting in a diametric direction. The operation pins 117*d*, 117*d* are respectively play-fit with annular rollers 117*e*, 117*e*, thus forming engagements so that each roller 117*e* can rotate on the operation pin 117*d*. The operation pin 117*d* inserted over with the roller 117*e* is engaged with the cam 116*e*. During rotation of the operation rod 117, rotating the roller 117*e* causes the operation pin 117*d* and roller 117*e* to move, with engagement, between the inclination-surface upper or lower end and the horizontal surface of the cam 116*e*. In FIG. 1, the operation pin 117*d* and roller 117*e* positions at the upper end of slant surface of the cam 116*e* correspondingly to a door closing state. However, the engaging part can be configured, in the door closing state, to position at the lower end of the cam or cam groove.

As a modification to the first example hinge 110 of the first embodiment, a recess 117*f* is formed generally in a semi-spherical form or the like in an outer side surface of the operation rod 117 generally in its lower end. A sphere 117*g* of steel or the like, in part, is received for rolling in the recess 117*f*. Furthermore, a grooved cam 116*f* generally in a semi-circular form with no penetration is circumferentially inscribed in such a foregoing form in an inner side surface of the piston 116. In a state the sphere 117*g* is clamed between the cam 116*f* and the recess 117*f*, the sphere 117*g* engaged with the cam 116*f* rolls along the cam 116*f*. The sphere 117*g* is allowed to move between the upper end of inclination surface and lower end of inclination surface or the horizontal surface. This structure suitably causes the operation rod and piston to effect an associated operation with further smoothness.

In the first example hinge 110 of the first embodiment, a compression coiled spring may be accommodated between the piston 116 top surface and the cap 114 underside within the cylinder 113. The compression coiled spring is to be compressed by an ascend of the piston 116 during opening the door, whose restoration force acts to force the piston 116 down. In association with a return motion of the piston 116, the other wing plate 112 rotates in a direction toward closing the door. Incidentally, the compression coiled spring may be appropriately provided in position or the like, provided that the other wing plate 112 is structured to rotate in a direction toward closing the door.

In the case of using the first example hinge 110 of the first embodiment, another hinge can be suitably used to rotate the other wing plate 112 in a direction toward closing the door. The other hinge has a piston received in a cylinder having a circular cylindrical form provided, for example, on one of a pair of wing plates, to engage an operation rod at fixed its upper part by the other wing plate so that the piston can be advanced and retracted associatively with a rotation of the other wing plate through the operation rod. The cylinder accommodates therein a compression coiled spring that is to be compressed by the piston movement during opening the door, to provide a structure that the other wing plate is rotated in the door closing direction associatively with the piston return operation due to a restoration force of the compression coiled spring. There is included, as a concrete example, to accommodate a compressed coiled spring at between the piston 116 top surface and the cap 114 underside within the cylinder 113, and the like.

When using the first example hinge 110 of the first embodiment, it is used together with the other hinge having an automatic closing door function to rotate the foregoing wing plate 112 in the door-closing direction. One wing plate 111 is attached on a doorframe or the like while the other wing plate 112 is on the door or the like. In the state the door is closed, the piston 116 positions at a lower region within the cylinder 113 while the engaging pin 117*d* and roller 117*e* (or sphere 117*g*) positions at an upper end of the cam 116*e* (or cam 116*f*).

When opening the door, the operation rod 117, engaging pin 117*d* and roller 117*e* is rotated by a rotation of the other wing plate 112, to move to nearly a lower end of the cam 116*e*. The piston 116 is moved upward by that movement, whereupon the sphere 116*b* rolls along the recess groove 113*b* in the cylinder 113 inner wall. In conjugation with the movement of the engaging pin 117*d* and roller 117*e* along the cam 116*e*, the piston 116 smoothly moves upward. Furthermore, due to an upward movement of the piston 116, air is admitted to between the underside 116*c* of the piston 116 and the upper part of the cap 115 through the air-intake port 115*c*, thus increasing or forming an air collection.

During closing the door, in case the engaging pin 117*d* and roller 117*e* is moved from a horizontal surface stopper to a slant surface position of the cam 116*e*, the door is automatically rotated in a direction closing the door by a restoration force of the compression coiled spring of the separately provided hinge. On this occasion, rotating the other wing plate 112 in the door closing direction causes the engaging pin 117*d* and roller 117*e* to move upward on the slant surface of the cam 116*e*, pushing down the piston 116. The piston 116 is smoothly descended through a movement of the engaging pin 117*d* and roller 117*e* along the cam 116*e* and a rolling of the sphere 116*b* along the recess groove 113*b*.

When the piston 116 descends, a valve plate 115*e* is urged against the air-intake port 115*c* to thereby close the air-intake port 115*c*. Accordingly, compressed is the air between the underside 116*c* of the piston 116 and the upper part of the cap 115. The compressed air is gradually discharge outside the cylinder 113 through from a gap between the smaller diameter hole 115*f* and the taper 115*k* to the discharge passage 115*m*, thus decreasing or vanishing the air collection. By gradual release of air, the door is smoothened in closing motion exhibiting a damp function by means of air cushioning action.

The above use example explained the case of separately using a hinge for rotating the other wing plate 112 in the door closing direction in addition to the first example hinge 110 of the first embodiment. However, single use is possible by a structure having both automatic closing door function and damping function, e.g. a modification arranging a compression coiled spring within the cylinder 113 of the hinge 110. Besides, the hinge 110 of the first example can be used without a modification.

Now a second example hinge 120 in the first embodiment is explained mainly on a different point from the first example hinge 110.

Figure 3:
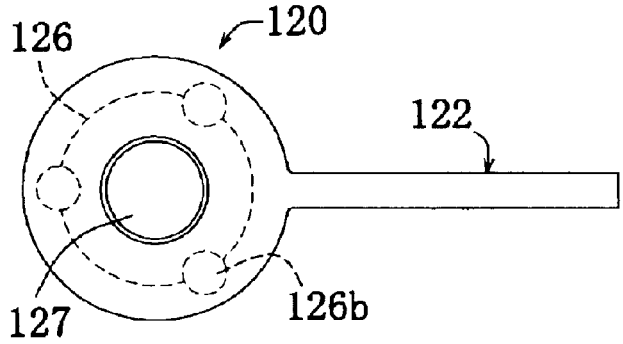
FIG. 3A is a plan view showing a hinge in a second example according to an automatic closing door mechanism in a first embodiment of the present invention.
FIG. 3B is a front view partly vertically broken away showing the hinge in the second example according to the automatic closing door mechanism in the first embodiment of the invention.
Figure 3:
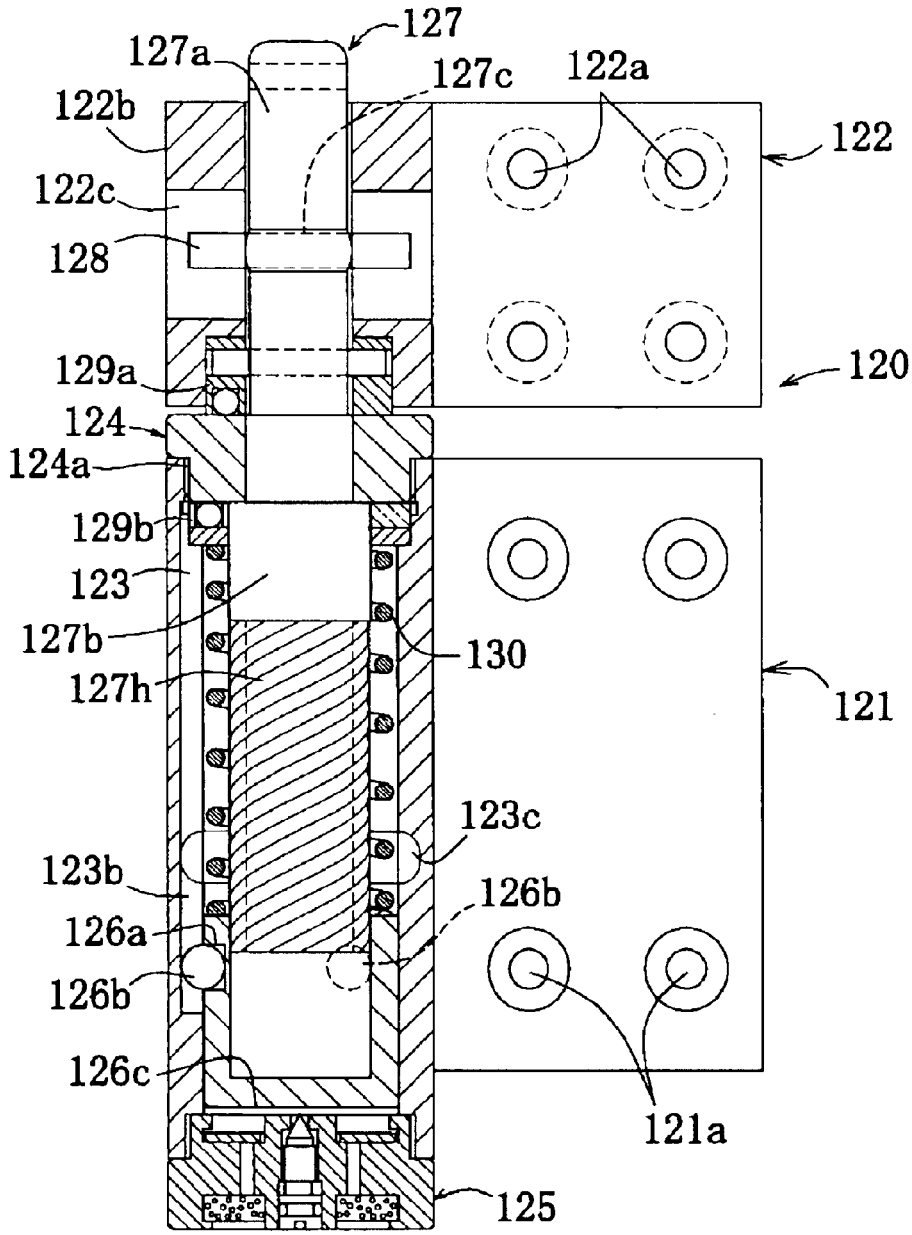

The second example hinge 120 of the first embodiment has, as shown in FIG. 3, one wing plate 121 forming mounting holes 121*a* and the other wing plate 122 forming mounting holes 122*a*. The other wing plate 122 is integrally provided with a cylindrical part 122*b*. The cylindrical part 122*b* is formed with a penetration hole 122*c* to insert therein an engaging pin 128 for fixing with an operation rod 127. The one wing plate 121 is integrally provided with a cylinder 123 having a circular cylindrical form. The cylinder 123 is formed with respective female threads at upper and lower ends, at the upper end of which is screwed a cap 124 generally in a short cylindrical form while, at the lower end, screwed is a cap 125 generally in a short cylindrical form. The cap 124 and cap 125 is the same in structure as the cap 114, 115 in the first example hinge 110, including the valve means and the like.

Within the cylinder 123, a piston 126 generally in a bottomed cylindrical form is accommodated for sliding in a vertical direction. Recesses 126*a*, generally in a cylindrical form, are formed in an outer surface generally at an upper end of the piston 126, in three points in this embodiment. Within the recesses 126*a*, spheres 126*b* made of steel or the like are arranged for rolling. On the other hand, three strips of recess grooves 123*b* are formed lengthwise in an inner wall of the cylinder 123. The sphere 126*b* is partially received in the recess 126*a* and in the recess groove 123*b* so that the sphere 126*b* can roll along the recess groove 123*b* while being held in the recess 126*a*. Due to rolling of the spheres 126*b*, the piston 126 is allowed to vertically, smoothly slide within the cylinder 123.

A recess groove 123*c* in a ring form is formed circumferentially of the cylinder 123 in its cylinder 123 inner wall, in a position somewhat lower than a center of the recess groove 123*b*. In case the sphere 126*b* moves up along the recess groove 123*b* and reaches a position of the ring-formed recess groove 123*c* due to an ascend of the piston 126, the sphere 126*b* enters the ring-formed recess groove 123*c* and rotates in the ring-formed recess groove 123*c*, whereby the piston 126 rotates together with the spheres 126*b*. Accordingly, the piston 126 is allowed to ascend to a point the sphere 126*b* comes to a position of the ring-formed recess groove 123*c*. Incidentally, the recess groove 123*b* can be structurally omitted in a region above the upper end of the ring-formed recess groove 123*c*. Meanwhile, it is suitable to circumferentially fit a packing or the like over the outer periphery at around the lower end of the piston 126, in order to keep the tightness of an air admitted in the space within the cylinder 123 at between the lower surface 126*c* of piston 126 and the upper part of cap 125.

An operation rod 127 is formed by a smaller diameter portion 127*a* generally in the upper half and a larger diameter portion 127*b* generally in the lower half. The smaller diameter portion 127*a* is inserted in a center of the cap 124 through an upper bearing 129*a* of the cap 124 and a lower bearing 129*b* thereof so that a top surface of the larger diameter portion 127*b* is in abutment against an underside of the cap 124. The smaller diameter portion 127*a* of the operation rod 127 is received in a cylindrical part 122*b* integrally formed with the other wing plate 122, and fixed by inserting or so an engaging pin 128 in a penetration hole 122*c* of the cylindrical part 122*b* and a penetration hole 127*c* of the smaller diameter portion 127*a*. Eight strips of male threads 127*h* are formed in an outer peripheral surface in the larger diameter portion 127*b* of the operation rod 127. The male threads 127*h* are screwed in the eight strips of female threads (not shown) formed in an inner peripheral surface of the piston 126. Depending upon rotation of the operation rod 127 and male thread 127*h*, the piston 126 structurally moves up and down.

A compression coiled spring 130 is provided between the bearing 129*b* positioned beneath the cap 124 and the upper end surface of the piston 126, thus urging the piston 126 down at all times. The piston 126 is urged and moved downward by a restoration force of the compression coiled spring 130. By a descend of the piston 126, the operation rod 127 screwed with the male thread 127*h* and the other wing plate 122 fixed to the operation rod 127 are structurally rotated in the door closing direction.

In using the first example hinge 120 of the first embodiment, one wing plate 121 is attached for example on a doorframe while the other wing plate 122 is on a door. In the state the door is closed, the compression coiled spring 130 is decompressed wherein the piston 126 urged down by the compression coiled spring 130 is in a lower region within the cylinder 123.

When opening the door, the operation rod 127 and male thread 127*h* rotates circumferentially by a rotation of the other wing plate 122 so that the piston 126 whose female thread is screwed by the male thread 127*h* is moved up by a rotation of the male thread 127*h*. When the piston 126 moves up, the sphere 126*b* rolls along the recess groove 123*c* in the cylinder 123 inner wall and the compression coiled spring 130 is compressed. The piston 126, despite urged down by the compression coiled spring 130, smoothly moves upward. Furthermore, by the upward movement of the piston 126, air is admitted to between the underside 126*c* of the piston 126 and the upper part of the cap 125 through valve means, increasing or forming an air collection.

The piston 126 finally ascends to a position where the sphere 126*b* enters the ring-formed recess groove 123*c*.

Thus, the sphere 126*b* enters the ring-formed recess groove 123*c*. When the sphere 126*b* is allowed to enter the ring-formed recess groove 123*c*, the sphere 126*b* rotates in the ring-formed recess groove 123*c* correspondingly to a rotation of the operation rod 127 and male thread 127*h*, which causes the piston 126 to rotate due to the rotation.

When the door is released from the hand, the compressed coiled spring 130 is released from its compression. The piston 126 is urged downward by a restoration force of the compression coiled spring 130. The piston 126 is rotated until the sphere 126*b* enters from the ring-formed recess groove 123*c* into the recess groove 123*b*. By entering of the sphere 126*b* in the recess groove 123*b*, the sphere 126*b* is rolled down along the recess groove 123*b* and the piston 126 is moved downward.

When the urged piston 126 descends, the air between the underside 126*c* of piston 126 and the upper part of cap 125 is compressed similarly to the first example hinge 110. The compressed air is gradually released to the outside of the cylinder 123 through the valve means, decreasing or vanishing the air collection. By gradually releasing the air, the door is moderated in closing motion thus exhibiting a damper function with the action of air cushioning.

By gradually releasing the air, the compression coiled spring 130 is decompressed by a restoration force thereof. Furthermore, the piston 126 urged by the compression coiled spring 130 gradually moves down while rolling the sphere 126*b* released from the ring-formed recess groove 123*c* along the recess groove 123*b*. Depending upon a descend of the piston 126, the operation rod 127 and the other wing plate 122 rotate gradually and smoothly. Consequently, the door attaching the other wing plate 122 is automatically rotated gradually and smoothly, to exhibit a favorable automatic door closing function and damper function.

Incidentally, the hinge 110, 120 in the automatic door closing mechanism, although made of a metal, is preferably made by a required component part as a resin-formed product having a required strength in order to prevent a failure resulting from the raster as caused upon use in a high humidity environment such as during rainy season or upon contact with water such as dew. The resin may use singly or in combination such appropriate resins as thermosetting resin and thermoplastic resin in kind. However, thermoplastic resin is preferred, in respect of production and recycling. Required additives can be added to these resins, e.g. addition of a carbon fiber, for increasing strength.

Figure 4:
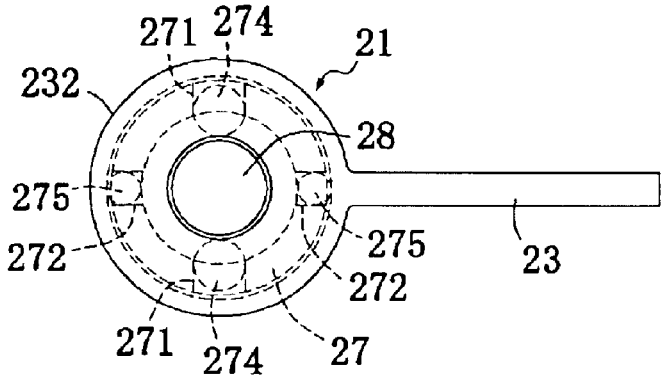
FIG. 4A is a plan view showing a hinge in a first example in a second embodiment of the present invention.
FIG. 4B is a front view partly vertically broken away showing the hinge in the first example in the second embodiment of the invention.
Figure 4:
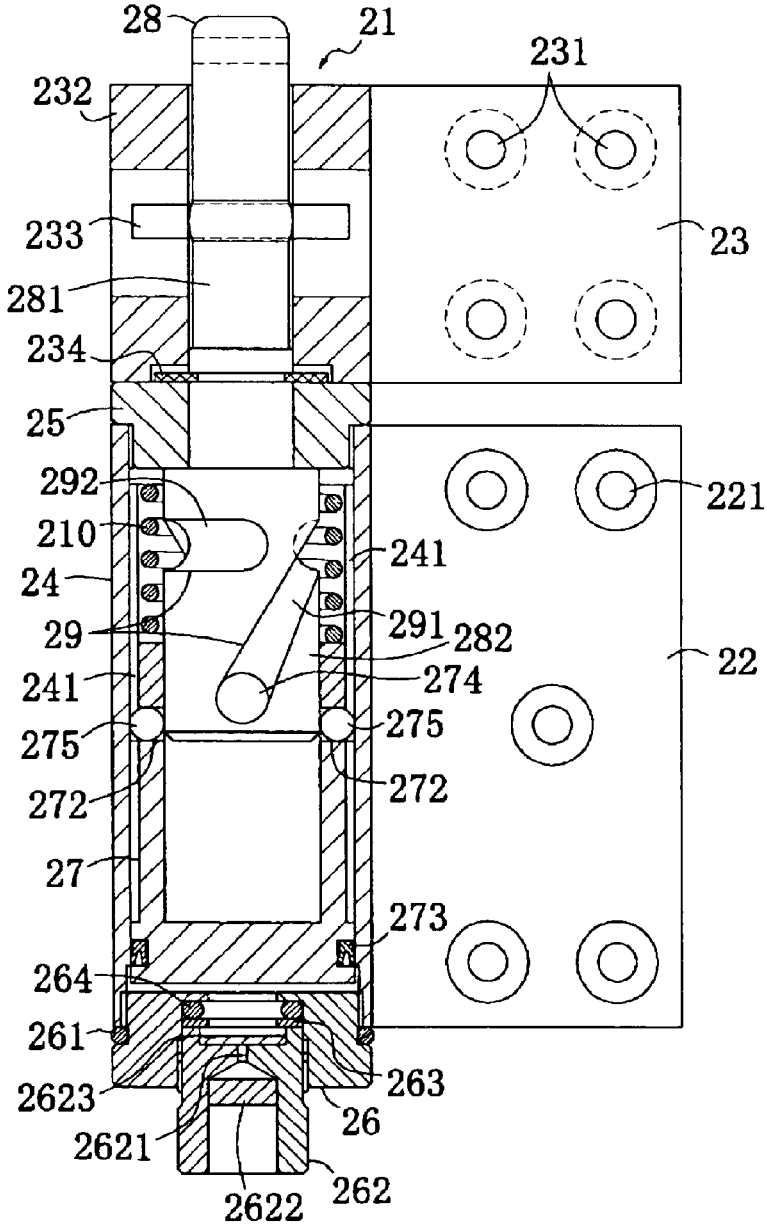

Now explained is a second embodiment of the invention. In the second embodiment, a hinge 21 of a first example has a pair of one wing plate 22 and the other wing plate 23 that are formed of metal, plastic or the like, as shown in FIG. 4. By inserting flat head screws or the like through the mounting holes 221, 231 formed in the wing plates 22, 23, one wing plate 22 is attached to a doorframe or the like while the other wing plate 23 is to an opening-and-closing door or the like.

The one wing plate 22 is integrally provided with a cylinder 24 having a circular cylindrical form. Screw threads are respectively formed at upper and lower ends of the cylindrical part 24. A cap 25 generally in a ring form is provided by screwing to the upper end while a cap 26 generally in a ring form is provided by screwing to the lower end. An O-ring 261 is fit in a lower end position of screw thread of the cap 26 in a state screwed in the lower end, whereby the air within the cylinder 24 can be prevented from flowing out through a screwing region between the cylinder 24 and cap 26.

The cap 26 is formed with a screw thread at nearly a lower end of a central hollow region, to have a generally cylindrical interior part 262 screwed in the screw thread. The interior part 262 is formed, therein, with an air flow-in port 2621 tapered to have a reduced diameter. Beneath the air flow-in port 2621, a filter 2622 is arranged in order to prevent dusts. A valve plate 2623 is rested above the air flow-in port 2621. The air, sucked at an air suction port at the lower end of the interior part 262, is admitted to the air flow-in port 2621 through the filter 2622. The valve plate 2623 is floated under a reduced pressure within the cylinder 24, so that air can flow in the cylinder 24 through the hollowed upper end of cap 26.

At the upper end of the screwed interior part 262, a ring 263 is rested which has a hole smaller than an outer diameter than the valve plate 2623. By a presence of the ring 263, the valve plate 2623 is arranged between the ring 263 and the air flow-in port 2621. An O-ring 264 is provided between an upper end of the interior part 262 projecting to the hollow region and an upper surface of the ring 263. During flowing out of air, the valve plate 2623 is urged against the air flow-in port 2621 and closes the same under a pressurization within the cylinder 24. Thus, the air gradually flows out, while being suppressed in flowing-out amount, through a cap 26 hollow region upper end and a vicinity of ring 263 and a screw thread where the interior part 262 and cap 26 are screwed together. Consequently, the interior part 262 is screwed to the cap 26 by being adjusted nearly at a strength for air to flow through the screw thread. Incidentally, the valve means, for flowing air from the external into the cylinder 24 and from the cylinder 24 to the external while suppressing it, is not limited to the structure of this example.

Within the cylinder 24, a piston 27 generally in a bottomed cylindrical form is arranged for sliding in a vertical direction. In nearly upper end of the piston 27, there are two penetration holes 271, 271 formed vertically opposed in a plan view as well as two penetration holes 272, 272 formed horizontally opposed in a plan view. The diameter of the penetration hole 272 is formed somewhat longer than a wall thickness of a peripheral wall of the piston 27. Meanwhile, the penetration hole 271 positions somewhat above the penetration hole 272, whose diameter is formed longer than the penetration hole 272.

The piston 27 has a lower end formed somewhat greater in diameter than the upper part. The lower end has a circumferential recess receiving therein a packing 273, to prevent the air, admitted to between the piston 27 underside and the cap 26 upper part, from flowing at the piston 27 underside toward the above thereby keeping air-tightness. Incidentally, it is preferred to coat a thin film resin or fit a resin-make cylinder generally in the same form in the cylinder 24 inner surface where the piston 27 lower part is to slide, because air-tightness is improved at between the piston 27 underside and the cap 26 upper part.

In the penetration hole 271 of the piston 27, a sphere 274 of steel or the like having generally the same diameter as the diameter of the penetration hole 271 is arranged for rolling, to protrude in the inner periphery of the piston 27. Also, in the penetration hole 272, a sphere 275 of steel or the like having generally the same diameter as the diameter of the penetration hole 272 is arranged for rolling, to protrude in the outer periphery of the piston 27. Meanwhile, the cylinder 24 has an inner diameter made somewhat smaller in the upper than the lower where the piston 27 at its lower end is to slide. In a position of the upper part corresponding to the penetration hole 272 of the piston 27, recess grooves 241 are formed lengthwise of the cylinder 24. The sphere 275, protruding in the outer periphery of the piston 27, in a state held at a predetermined position in the penetration hole 272, engages in the recess groove 241 and rolls vertically along the recess groove 241. Due to this, the engagement between the sphere 275 and the recess groove 241 acts as a rotation-stopper to place the piston 27 not rotatable circumferentially but allow it to vertically slide smoothly within the cylinder 24.

Meanwhile, the operation rod 28 has a smaller diameter portion 281 in the upper and a larger diameter portion 282 in the lower. The smaller diameter portion 282 is fit in a hollow part of the cap 25 while the larger diameter portion 282 is in a state that its top surface is in an abutment against the underside of the cap 25. The smaller diameter portion 281 is fit in a cylindrical part 232 formed integral on the other wing plate 23 and fixed to the other wing plate 23 through an engaging pin 233. The longer diameter portion 282 is accommodated within the cylinder 24. Incidentally, a snap ring 234 is arranged on an outer periphery of the smaller diameter portion 281, at a lower end of the cylindrical part 232.

In the larger diameter portion 282 accommodated in the cylinder 24, two strips of cam grooves 29 are formed oppositely in the outer periphery thereof. Each cam groove 29 is formed by a slant region 291 formed from its lower end to a generally upper part and a horizontal region 292 formed generally horizontal continuing from the slant region 291, which is formed in such a position that the lower end of the slant region 291 is in a height of the penetration hole 271 when the piston 27 descends to the lowest end. The slant region 291 has a slant gradually moderating toward the above. Incidentally, the cam groove 29 is formed with a predetermined angle to cope with a rotation of the door at a predetermined angle of 180 degrees or smaller. The can groove 29 is not limited to the two strips but can be provided one strip, three strips, four strips or the like.

Each cam groove 29 is engaged with a sphere 274 protruding in the inner periphery of the piston 27. The sphere 274 rolls along the cam groove 29. The sphere 274 moves in the cam groove 29, in a state held at a predetermined position in the penetration hole 271. During movement of the sphere 274 along the slant region 291 of the cam groove 29, movement is associative between a rotation of the other wing plate 23 and operation rod 28 and an advancement/retraction of the piston 27 as vertical movement within the cylinder 24. During movement of the sphere 274 in the horizontal region 292 of the cam groove 29, the piston 27 is structurally stopped in the highest position relative to the rotational motion of the other wing plate 23 and operation rod 28. Accordingly, the horizontal region 292 of the cam shaft 29 has a function as a stopper to maintain a door opened state.

Meanwhile, within the cylinder 24, a compression coiled spring 210 is arranged between a top end face of the piston 27 peripheral wall and an underside of the cap 25. The compression coiled spring 210 loaded is to be compressed by an ascend of the piston 27 that the sphere 274 moves upward along the slant region 291 of the cam groove 29, during door opening operation to rotate the other wing plate 23 and operation rod 28. The compressed state is maintained by the sphere 274 staying in the horizontal region 292, into a door opened state. In order to release the door opened state, the other wing plate 23 and operation rod 28 is somewhat rotated toward closing the door, to move the sphere 274 from the horizontal region 292 to the slant region 291 thereby releasing a restoration force of the compression coiled spring 210. Due to this, through the restoration force, the compression coiled spring 210 descends the piston 27. Furthermore, due to the descend operation, the sphere 274 moves down along the slant region 292, to rotate the other wing plate 23 and operation rod 28 thereby automatically causing a door closing action.

In using the first example hinge 21 of the second embodiment, two hinges 21, 21 for example are used as one set, to attach one wing plate 22 of the hinge 21 on a doorframe while the other wing plate 23 on a door, thereby structuring an automatic closing door mechanism. In the attached hinge 21 in a door closed state, the sphere 274 is at the lowest end in the cam groove 29 within the cylinder 24. The piston 27 is in a position that its underside is close to the top surface of the cap 26. Incidentally, the hinges 21 used on the automatic door closing mechanism are in a suitable number.

In case the door is opened, the other wing plate 23 fixed on the door and the operation rod 28 are rotated by a door opening action. By rotating the cam groove 29, the sphere 274 moves up along the slant region 291 of the cam groove 29. The piston 27 ascends while compressing the compression coiled spring 210. On this occasion, the sphere 275 rolls along the recess groove 241, to smoothen to ascend the piston 27. Furthermore, due to an ascend of the piston 27, the pressure is reduced at between the cap 26 top surface and the piston 27 underside within the cylinder 24. By the pressure reduction, the valve plate 2623 is floated to cause air to flow through the air flow-in port 2621 to between the cap 26 top surface and the piston 27 underside within the cylinder 24, increasing or forming an air collection.

In case the door is rotated a predetermined angle or greater, e.g. 90 degrees, the other wing plate 23 and operation rod 28 rotates through the predetermined angle or greater. The sphere 274 moves from the slant region 291 to the horizontal region 292 of the cam groove 29, to stop the piston 27 from ascending and air from flowing in. The piston 27 is held at the stopped position, thus maintaining the door opened state. Meanwhile, by holding the piston 27 in the predetermined position, the compressed coiled spring 210 is also held in a compressed state.

In the case to release the door opened state, the door is somewhat rotated toward closing, to rotate the other wing plate 23 and operation rod 28 in the door closing direction. Due to this, the sphere 274 is moved from the horizontal region 292 to the slant region 291 of the cam groove 29, to release the restoration force of the compression coiled spring 210 in a compressed state. By the restoration force, the compressed coiled spring 210 urges the piston 27 so that the piston 27 compresses the air of the air collection and descends while gradually flowing it out. Due to a descend of the piston 27, the sphere 274 gradually moves down along the slant region 291 while the other wing plate 23 and operation rod 28 rotates. Consequently, the door is automatically closed by flowing out the air with suppression while being damped by an action of air cushioning. Thus, the air collection is reduced or vanished to place the door into a closed state. Incidentally, in the case that the door opening operation is halted at a predetermined angle before reaching of the sphere 274 moving in the slant region 291 to the horizontal region 292, the door opened state is not maintained. The restoration force of the compression coiled spring 210 is released at the time point of stoppage, to automatically close the door while being damped by an action of air cushioning, similarly to the foregoing.

Now explained is a second example of the second embodiment, mainly on the different point from the first example.

Figure 5:
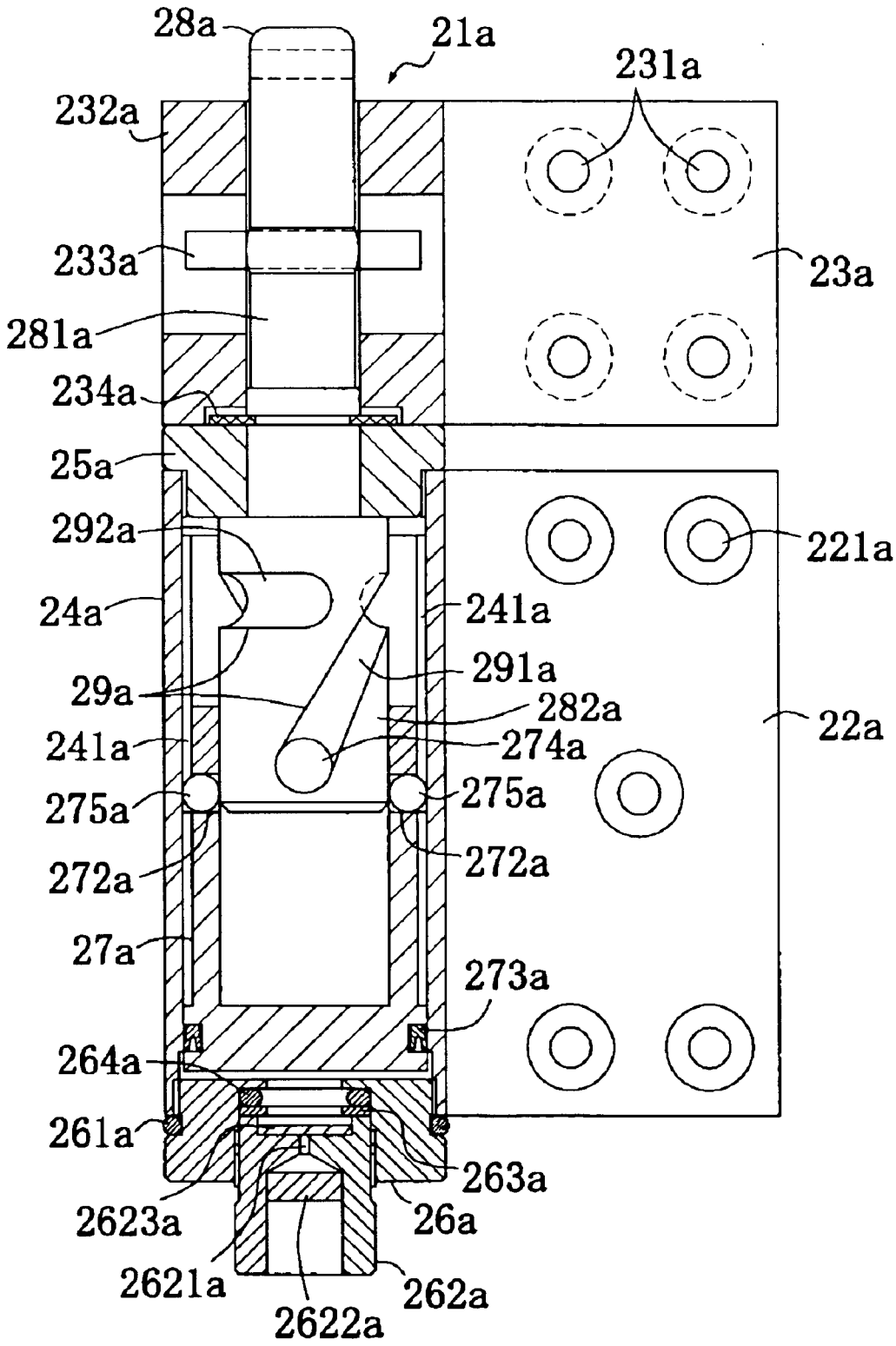
FIG. 5 is a longitudinal sectional view showing a first hinge of a second example in the second embodiment of the invention.
Figure 6:
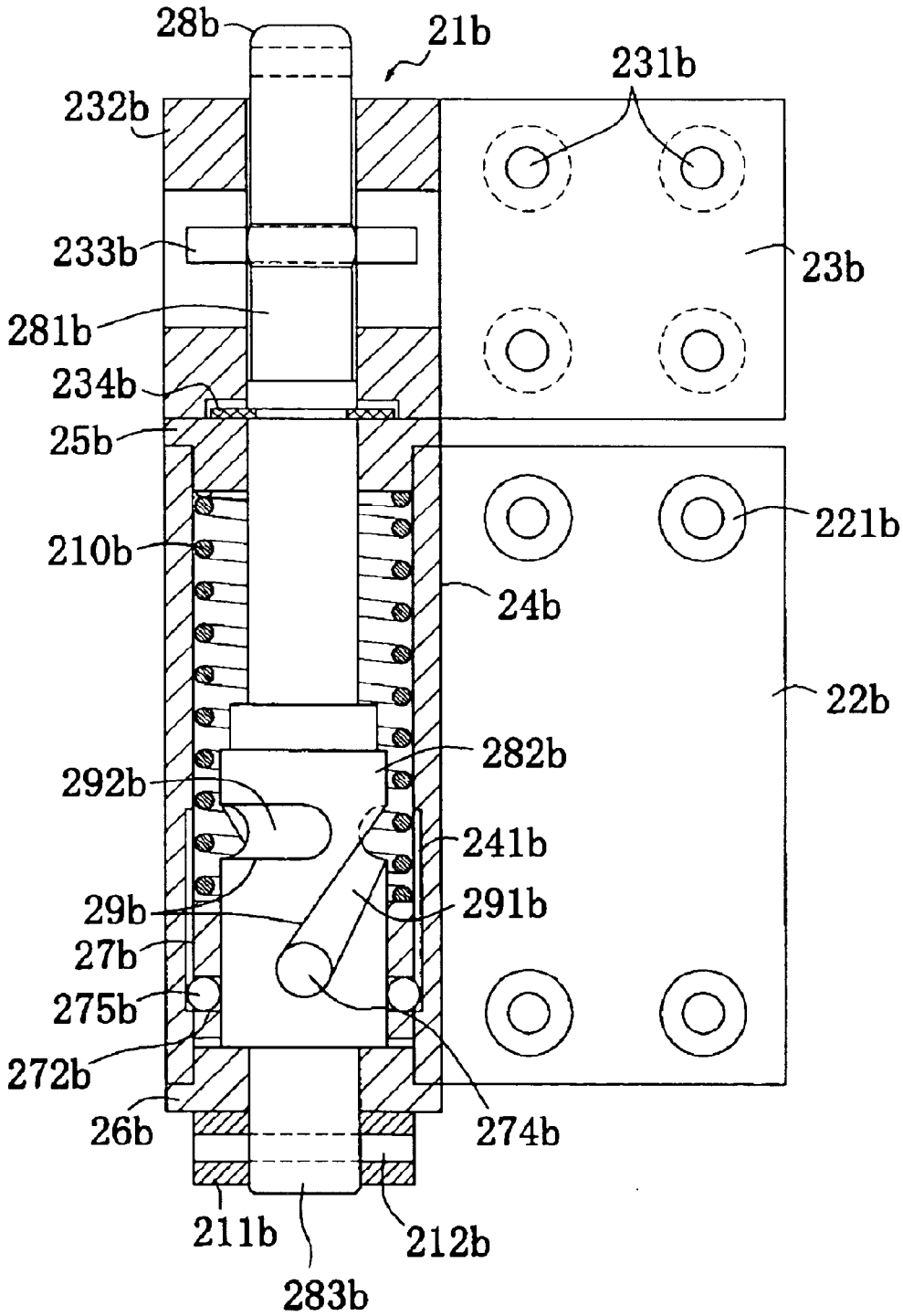
FIG. 6 is a longitudinal sectional view showing a second hinge of a second example in the second embodiment of the invention.

An automatic closing door mechanism of a second example has a first hinge 21*a* for a role of damping function during door closing operation and a second hinge 21*b* for a role of automatic door closing operation. This example uses, as one set, one first hinge 21*a* and one second hinge 21*b* one in the number. Incidentally, the first hinge 21*a* and second hinge 21*b* used on the automatic closing door mechanism is in a suitable number, in accordance with the necessity. The first hinge 21*a* is in a structure not having an automatic door closing function removed of the compression coiled spring 210 from the first example hinge 21 of the second embodiment, wherein the other structure is the same as the first example hinge 21. In FIG. 5, the element of the first hinge 21*a* corresponding to the element of the first example hinge 21 of the second embodiment is denoted by a references attaching a to the corresponding element of the first example hinge 21. Also, in FIG. 6, the element of the second hinge 21*b* corresponding to the element of the first example hinge 21 of the second embodiment is denoted by a reference attaching b to the corresponding element of the first example hinge 21.

The operation rod 28*b* of the second hinge 21*b*, at its upper smaller diameter portion 281*b*, is fixed to the cylindrical part 232*b* of the other wing plate 23*b* and inserted in a cap 25*b* in the upper end of the cylinder 24*b*. The operation rod 28*b* accommodated in the cylinder 24*b* has a larger diameter portion 282*b* provided in the lower end thereof. Two cam grooves 29*b* are formed oppositely in an outer periphery of the longer diameter portion 282*b*. Furthermore, a smaller diameter portion 283*b* is projected at the below of the larger diameter portion 282*b* of the operation rod 28*b*. The smaller diameter portion 283*b* is inserted in a central hollow part in a center of the cap 26*b* attached to a lower end of the cylinder 24*b*. The smaller diameter portion 283*b*, a collar 211*b* is fit over in the below of the cap 26*b*, is fixed to the collar 211*b* by an engaging pin 212*b*.

Within the cylinder 24*b*, a piston 27*b* in a cylindrical form is accommodated for vertical sliding. The piston 27*b* has penetration holes 271*b*, 272*b*, similarly to the first example hinge 21. In the penetration hole 271*b*, a sphere 274*b* is arranged for rolling, projecting in an inner periphery of the piston 27*b*. Also, in the penetration hole 272*b*, a sphere 275*b* is arranged for rolling, projecting in an outer periphery of the piston 27*b*. The sphere 275*b*, in a state held at a predetermined position in the penetration hole 272*b*, rolls while engaging with a recess groove 241*b* formed lengthwise of the cylinder 24 whereby the piston 27*b*, in a state not rotatable circumferentially, is allowed to smoothly slide vertically within the cylinder 24*b*.

The sphere 274*b* rolls while engaging with the cam groove 29*b*, which in a state held in a predetermined position in the penetration hole 271*b*, moves along the cam groove 29*b*. While the sphere 274*b* is moving in the slant region 291*b* of the cam groove 29*b*, motion is associative between a rotation of the other wing plate 23*b* and operation rod 28*b* and an advancement/retraction of the piston 27*b* vertically moving within the cylinder 24*b*. During movement of the sphere 274*b* in the horizontal region 292*b* of the cam groove 29*b*, the piston 27*b* structurally halts its vertical advancement/retraction relative to the rotation of the other wing plate 23*b* and operation rod 28*b*. The slant region 291*b* and horizontal region 292*b* of the cam groove 29*b* is formed corresponding, in inclination angle or the like, to the slant region 291*a* and horizontal region 292*b* of the cam groove 29*a* in the piston 27*a* of the first hinge 21*a*.

A compression coiled spring 210*b* is arranged between an upper end face of the piston 27*b* peripheral wall and an underside of the cap 25*b*. The loaded compression coiled spring 210*b* is to be compressed by an ascend of the piston 27*b* due to an upward movement of the sphere 274*b* along the slant region 291*b* of the cam groove 29*b*, during door opening operation to rotate the other wing plate 23*b* and operation rod 28*b*. Its compressed state is to be maintained by the sphere 274*b* staying in the horizontal region 292*b*. The other wing plate 23*b* and operation rod 28*b* is somewhat rotated in a door closing direction, to move the sphere 274*b* from the horizontal region 292*b* to the slant region 291*b* thereby releasing a restoration force of the compression coiled spring 210*b*. Due to this, the compression coiled spring 210*b* causes the piston 27*b* to descend. At the same time, the sphere 274*b* is moved down along the slant region 292*b* by the descending. By rotating the other wing plate 23*b* and operation rod 28*b*, a door closing operation is automatically effected.

In the case of using an automatic closing door mechanism having, as one set, one first hinge 21*a* and one second hinge 21*b* for example, the respective one wing plates 22*a*, 22*b* of the hinges 21*a*, 21*b* are attached on a doorframe while the other wing plates 23*a*, 23*b* are on a door, thereby structuring an automatic closing door mechanism. In case the door is opened, the other wing plate 23*a*, 23*b* and operation rod 28*a*, 28*b* rotates to rotate the cam groove 29*a*, 29*b* thereby moving up the spheres 274*a*, 274*b* respectively along the slant regions 291*a*, 291*b*. The piston 27*b* of the second hinge 21*b* ascends while compressing the compression coiled spring 210*b*. Meanwhile, the pressure within the cylinder 24*a* is reduced by an ascend of the piston 27*a*. By the pressure reduction, the valve plate 2623*a* is floated up to cause air to flow through the air flow-in port 2621 to between the cap 26*a* top surface and the piston 27*a* underside within the cylinder 24*a* of the first hinge 21*a*, increasing or forming an air collection.

In case the door is rotated a predetermined angle or greater, e.g. 90 degrees, the spheres 274*a*, 274*b* respectively move from the slant regions 291*a*, 291*b* to the horizontal regions 292*a*, 292*b* and the pistons 27*a*, 27*b* are stopped from ascending and held in the position, thus maintaining a door opened state. On this occasion, in the first hinge 21*a*, air is ceased from flowing into the cylinder 24*a*. On the other hand, in the second hinge 21*b*, the compression coiled spring 210*b* is held in a compressed state.

In case the door is somewhat rotated in the door closing direction to thereby rotate the other wing plate 23*a*, 23*b* and operation rod 28*a*, 28*b* in the door closing direction, the spheres 274*a*, 274*b* respectively move from the horizontal regions 292*a*, 292*b* of the cam grooves 29*a*, 29*b* to the slant regions 291*a*, 291*b*, to release a state the opened door is maintained. In the second hinge 21*b*, the compression coiled spring 210*b* in a compressed state releases its restoration force. By the restoration force, the compression coiled spring 210*b* in the second hinge 21*b* urges and descends the piston 27*b*. By descending the piston 27*b*, the sphere 274*b* moves down along the slant region 291*b*. The other wing plate 23*b* and operation rod 28*b* rotates to automatically rotate the door in the door closing direction.

By the door closing operation, the other wing plate 23*a* and operation rod 28*a* in the first hinge 21*a* is rotated in the door closing direction, to move down the sphere 274*a* along the slant region 291*a* of the cam groove 29*a*. The piston 27*a* descends while compressing and gradually flowing out the air in the air collection. Consequently, the air is flowed out while being suppressed whereby the door automatically goes to a closure while being damped by an action of air cushioning, decreasing or vanishing the air collection and placing the door into a closed state. Incidentally, in case a door opening is halted at a predetermined angle before the sphere 274*a* moving in the slant region 291*a*, 291*b* reaches the horizontal region 292*a*, 292*b*, the door opened state is not maintained. The compressed compression coiled spring 210*b* releases its restoration force from a time point of the stoppage, to automatically close the door while damping it by an action of air cushioning similarly to the foregoing.

Now explained is a third example of the second embodiment, mainly on a point different from the first and second example.

Figure 7:
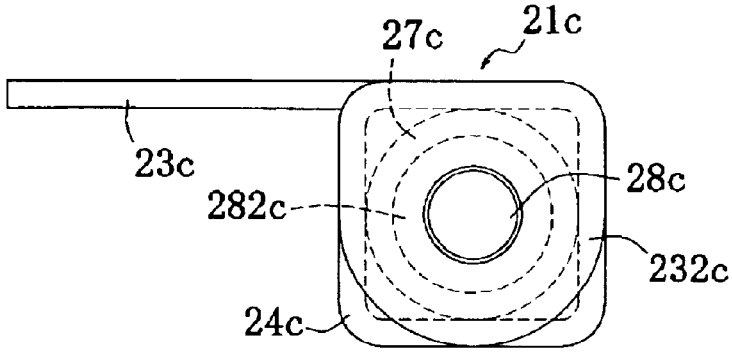
FIG. 7A is a plan view showing a hinge of a third example in the second embodiment of the invention.
FIG. 7B is a longitudinal sectional view showing a hinge of the third example in the second embodiment of the invention.
Figure 7:
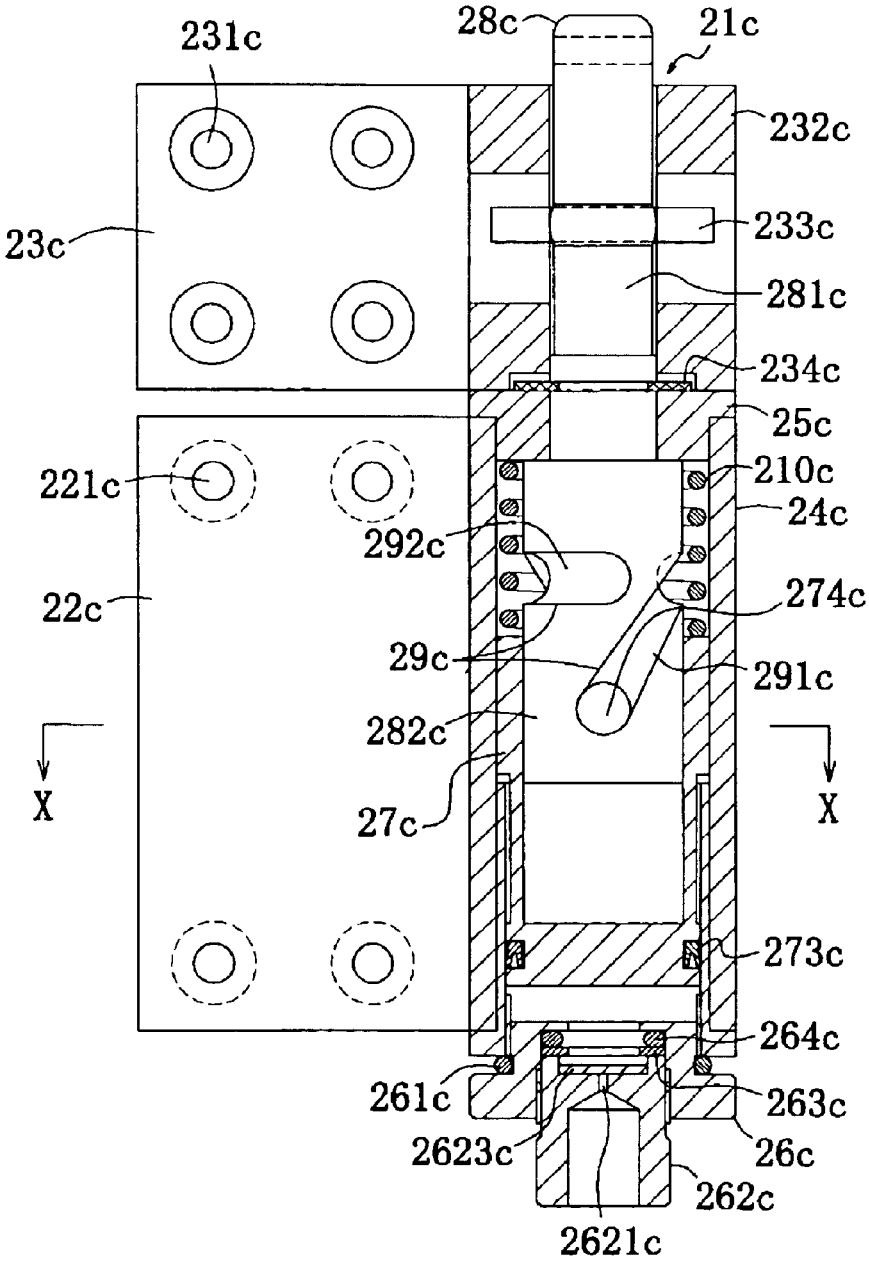
Figure 8:
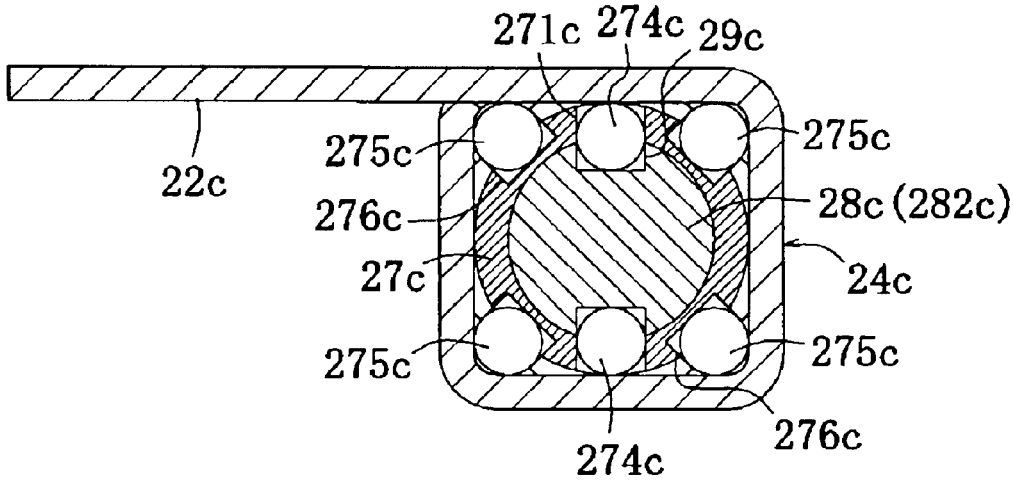
FIG. 8 is an X—X cross sectional view in FIG. 7B.

In the second embodiment, a third example hinge 21*c* as shown in FIGS. 7 and 8 is generally in the same structure as the first example hinge 21 of the second embodiment. However, the cylinder 24*c* provided in one wing plate 22*c* is formed generally square in plan or cross-sectional view. The cylindrical part 23*c* provided in the other wing plate 23*c* has a form in plan or cross-sectional view formed in a shape connecting, at both ends, a squared-U part obtained by halving a generally square and a generally semi-circular part having a diameter nearly same in length as one side of the generally square, or generally a tongue form. Incidentally, in FIGS. 7 and 8, the element of the hinge 21*c* corresponding to the element of the first example hinge 21 is denoted by a reference attaching c to the reference of the corresponding element of the first example hinge 21.

A circular cylindrical space is formed generally in a lower region within the cylinder 24*c*, at above of which is formed a cuboid space. A piston 27*c* in a bottomed cylindrical form is received in the circular cylindrical space. Two penetration holes 271*c*, 271*c* are formed vertically in plan view in a position, at a predetermined height, at generally above the piston 27*c*. In the penetration hole 271*c*, a sphere 274*c* is arranged for rolling. The sphere 274*c* protrude from an inner periphery of a piston 27*c* peripheral wall. Each sphere 274*c* engages with a cam groove 29*c* having a slant region 291*c* and horizontal portion 292*c* formed opposed to an outer periphery of the larger diameter portion 282 of the operation rod 28*c*. The sphere 274*c* moves along the slant region 291*c* of the cam groove 29*c*. The structure, the motion is associative between a rotation of the other wing plate 23*c* and operation rod 28*c* and an advancement/retraction of the piston 27*c*, is similar to the above example.

Four recesses 276*c* are formed in positions nearly the same as or somewhat lower in height than the penetration hole 271*c* and corresponding to four corners of the cylinder 24*c*. In each recess 276*c*, a sphere 275*c* is arranged for rolling, projecting from the outer periphery of the piston 27*c*. The sphere 275*c* is clamped between the cylinder 24*c* corner and the recess 276*c*, thus prohibited from moving circumferentially. In the case the piston 27*c* vertically advances and retracts, the sphere 275*c* rolls and moves along the lengthwise of the cylinder 24*c* corner. The spheres 275*c* engaged at the corners act as a rotation-stopper, whereby the piston 27*c* is prohibited from rotating circumferentially but the piston 27*c* is caused to smoothly slide vertically. By utilizing the protrusions from a circle, such as the corners, as a space to move the spheres 275*c* for sliding the piston 27*c*, there is no need to separately form a recess groove for moving the sphere 275*c* lengthwise of the cylinder 24*c* while prohibiting the piston 27*c* from rotating, thus facilitating working. Incidentally, in order to make easy the sphere to move lengthwise of the cylinder, the protrusions such as the corners may form therein a groove having the same shape, in cross section, as the sphere along the lengthwise of the cylinder.

Meanwhile, within the cylinder 24*c*, a compression coiled spring 210*c* is loaded and arranged between the upper end face in the piston 27*c* peripheral wall and the cap 25*c* underside. Similarly to the foregoing example, the compression coiled spring 210*c* is to be compressed by an ascend of the piston 27*c* due to an upward movement of the sphere 274*c* along the slant region 291*c* of the cam groove 29*c* during opening the door, and maintained in a compressed state due to the sphere 274*c* staying in the horizontal region 292*c*. Meanwhile, by a movement of the sphere 274*c* from the horizontal region 292*c* to the slant region 291*c* to release a restoration force of the compression coiled spring 210*c*, the compression coiled spring 210*c* moves the piston 27*c* down. In the downward movement, the sphere 274*c* moves down in the slant region 291*c*, to rotate the other wing plate 23*c* and operation rod 28*c*, thereby automatically causing a door closing operation.

Incidentally, the manner of use and operation of the hinge 21*c* of this example is basically similar to the hinge of the first example. Also, although the hinge 21*c* of this example has the compression coiled spring 210*c* within the cylinder 24*c*, the hinge may be not internally provided with the compression coiled spring 210*c*. In this case, the hinge is made as a hinge to play a role of damping function during closing the door. Similarly to the second example in the second embodiment, a compression coiled spring may be internally provided in another hinge so that the other hinge can play a role of automatic door closing function utilizing contraction and restoration of the spring. It is preferred to structure an automatic closing door mechanism having a damping function by using both the hinge and the other hinge.

Now explained is a modification to a hinge cylinder of the second embodiment. Incidentally, in FIGS. 9 to 11, the element of the hinge corresponding to the element of the first example hinge 21 of the second embodiment is with a reference attaching d, e, f respectively to the reference of the corresponding element of the first example hinge 21.

Figure 9:
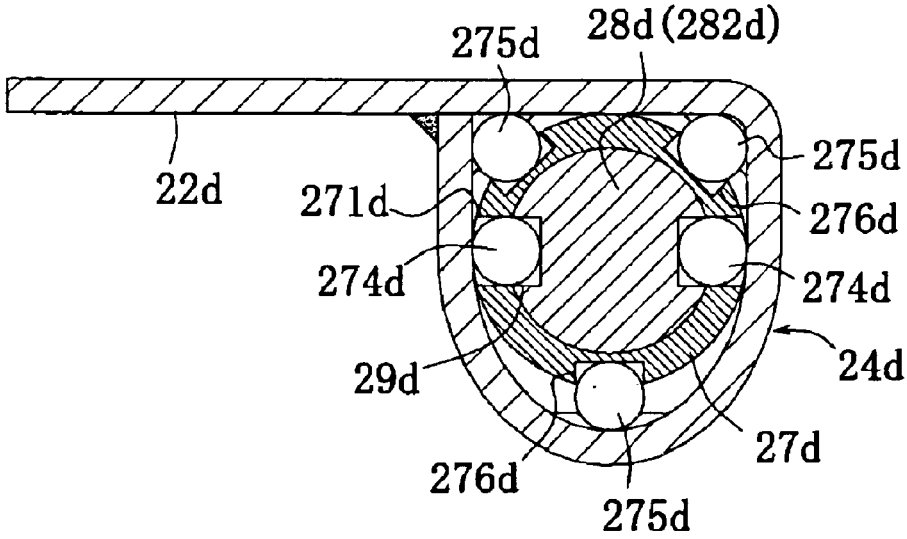
FIG. 9 is a cross sectional view showing a first modification of a cylinder in the second embodiment of the invention.

A cylinder 24*d* of a first modification has a cross-sectional form that is formed, as shown in FIG. 9, in a shape connecting, at both ends, a squared-U part obtained by halving a generally square and a generally semi-elliptical part having a shorter axis nearly same in length as one side of the generally square, or generally a tongue form. In the piston 27*d*, there are provided two penetration holes 271*d*, 271*d* opposed in the horizontal direction. A sphere 274*d* is arranged in each penetration hole 271*d*, movably projecting in an inner periphery. The sphere 274*d* is movably engaged with a cam groove 29*d* of an operation rod 28*d*. Meanwhile, at an inner position of a center of the semi-elliptical part and inner positions of two corners of the squared-U part, three spheres 275*d* are arranged for rolling in the respective recesses 276*d* of the piston 27*d*, for prohibiting rotation of the piston 27*d* not to allow circumferential rotation but to smoothen for the piston 27*d* to slide lengthwise of the cylinder 24*d*.

Figure 10:
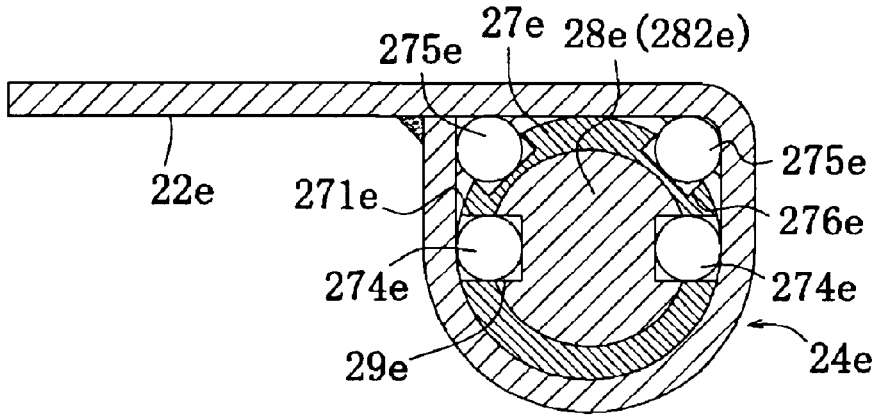
FIG. 10 is a cross sectional view showing a second modification of a cylinder in the second embodiment of the invention.

Meanwhile, a cylinder 24*e* of a second modification has a cross-sectional form that is formed, as shown in FIG. 10, in a shape connecting, at both ends, a squared-U part obtained by halving a generally square and a generally semi-circular part having a diameter nearly the same in length as one side of the generally square, or generally a tongue form. In the piston 27*e*, there are provided two penetration holes 271*e*, 271*e* opposed in the horizontal direction, similarly to the above. A sphere 274*e* is arranged for rolling in each penetration hole 271*e*. The sphere 274*e* is movably engaged with a cam groove 29*e* of an operation rod 28*e*. Meanwhile, at inner positions of two corners of the squared-U part, two spheres 275*e* are arranged for rolling in the recesses 276*e*, for prohibiting rotation of the piston 27*e* not to allow circumferential rotation but to smoothen for the piston 27*e* to slide lengthwise of the cylinder 24*e*.

The tongue form in the cylinder 24*d*, 24*e* of the first and second embodiment is in a suitable direction. In the above example, relative to the wing plates 22*d*, 22*e* in a horizontal direction in a cross-sectional view, a generally semi-elliptic part or generally semi-circular part of the cylinder 24*d*, 24*e* positioned in the lower right has a center positioned lower in a vertical direction, wherein a bottom side opposed thereto is formed positioned upper in the vertical direction. However, it may be formed vertically inverted. Meanwhile, relative to the wing plates 22*d*, 22*e* in the horizontal direction, the generally semi-elliptical part center or generally semi-circular part center of the cylinder 24*d*, 24*e* positioned right may be formed right in the horizontal direction, wherein a bottom side opposed thereto is formed positioned left in the horizontal direction. Otherwise, it is properly formed, e.g. reverse left and right to the above. Also, in the invention, the cylinder is to be provided in a proper position relative to the wing plate, e.g. providing a cylinder 24*d*, 24*e* in the lower left of the wing plates 22*d*, 22*e* in the horizontal direction in the cross-sectional view.

Figure 11:
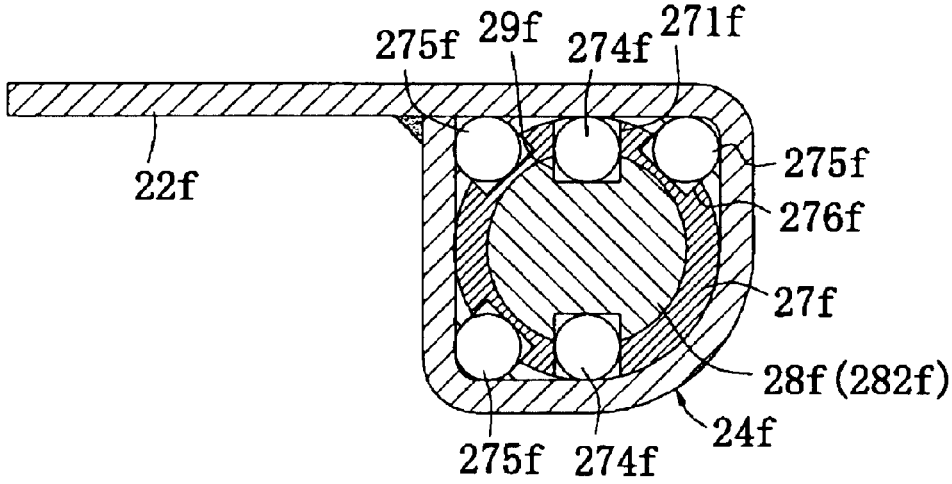
FIG. 11 is a cross sectional view showing a third modification of a cylinder in the second embodiment of the invention.

Meanwhile, a cylinder 24*f* of a third modification, in its cross-sectional form, is formed in a shape that one corner of a generally square is replaced with a generally circular part having generally 90 degrees, or generally in a fan shape, as shown in FIG. 11. In the piston 27*f*, there are formed two penetration holes 271*f*, 271*f* horizontally opposed. A sphere 274*f* is arranged for rolling in each penetration hole 271*f*, projecting in the inner periphery. The sphere 274*f* is movably engaged with the cam groove 29*f* of the operation rod 28*f*. Also, at inner positions of the other three corners of the generally square than the generally 90-degree circular part, three spheres 275*f* are arranged for rolling respectively in the recesses 276*f* of the piston 27*f*, for prohibiting rotation of the piston 27*f* not to allow circumferential rotation but to smoothen for the piston 27*f* to slide lengthwise of the cylinder 24*f*.

The generally fan shape of the cylinder 24*f* is in a suitable direction. Although the above example formed the cylinder 24*d*, 24*e* positioned lower right relative to the horizontal wing plate 22*f*, in a cross sectional view, has a generally circular part positioned lower right. However, it may be formed such that the generally circular part positions upper right, upper left or lower left. Meanwhile, as another modification, the cylinder in its cross sectional form may be in such a form that connected, at both ends, are a circular part having generally 270 degrees and an L-form having generally 90 degrees. In this case, the corner of the L-form part is a projection, and a sphere moving lengthwise of the cylinder is provided at the projection. The above form is in a proper forming position and direction.

Besides the cylinder form in the second embodiment or in the first, second and third modification, the cylinder is suitable in form. In the case of a form other than a circle, the cylinder is preferably made in a cross-sectional form having at least one protrusion from a circle, wherein the protrusion is provided lengthwise within the cylinder so that the piston spheres can move along all or proper ones of protrusions to thereby place the piston not rotatable circumferentially but allowing the piston to smoothly move within the cylinder. Meanwhile, because the cylinder cross-sectional form can be made as a hinge in various forms, such as hexagon, ellipse and the like, making possible to achieve design level improve or versatility.

Incidentally, in the invention, the number of spheres engaged with the cam grooves or spheres moving lengthwise of the cylinder, arrangement position, cam groove form, number, forming position and the like are proper within a limit the operational effect or function is available in the invention. Also, the motion transmission mechanism for associating between a rod rotation and piston advancement/retraction by an engagement of a cam groove having a slant formed in the rod and a piston sphere is not limited to the use in an automatic closing door mechanism having a damping function, or a hinge thereof, of the invention but can be used independently. In such a case, particular items of the automatic closing door mechanism having a damping function, or a hinge thereof, of the invention can be properly added as required within a limit that usable and the operational effect or function thereof is available.

Also, each hinge may form a circumferential recess groove, such as a ring-formed recess groove connected to a recess groove formed lengthwise within the cylinder so that the sphere moving lengthwise can move engaging with the circumferential recess groove in the predetermined position thereby placing the piston advancement/retraction in a stopped state and maintaining a door opened state. Use is possible in place of or together with a stopper due to the cam groove horizontal region. The stopper due to the circumferential recess groove is suitably used in an automatic closing door mechanism having a damping function having the action of air cushioning, or a hinge thereof, that the operation rod rotation and piston advancement/retraction in the entire or part are associated by an engagement between the female thread formed in a piston inner periphery and the male thread formed in an operation rod outer periphery.

Figure 12:
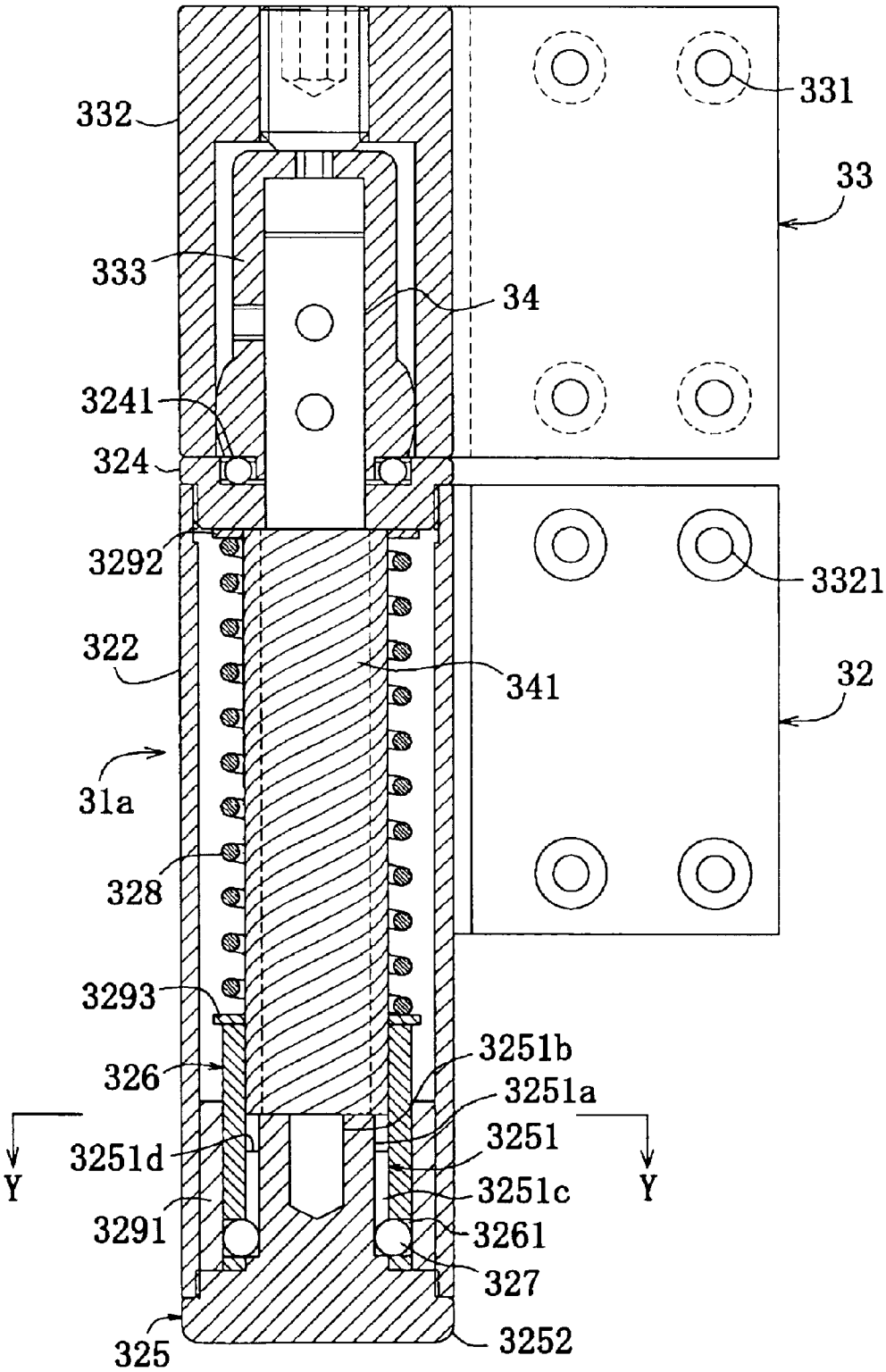
FIG. 12 is a longitudinal sectional view showing a hinge of a first example in the third embodiment of the invention.

Now explained is a third embodiment of the invention. A hinge 31*a* in a first example of the third embodiment, as shown in FIG. 12, is a hinge for playing a role of automatic closing door function, e.g. to be used in a set with another hinge to play a role of a damping function in door closing by the action of air cushioning thereby structuring an automatic closing door mechanism. Incidentally, the first example hinge 31*a* itself may given a damping function in door closing by the action of air cushioning through flowing air into/out of the cylinder. The hinge 31*a* has a pair of one wing plate 32 and the other wing plate 33 that are formed of metal, plastic or the like, as shown in FIG. 12. By inserting flat head screws or the like through the mounting holes 321, 331 formed in the wing plates 32, 33, one wing plate 32 is attached to a doorframe or the like while the other wing plate 33 is to an opening-and-closing door or the like.

The one wing plate 32 is integrally provided with a cylinder 322 having a circular cylindrical form. In the upper and lower ends of the cylinder 322, screw threads are respectively formed, at an upper end of which is fixed, by screwing, a cap 324 in generally a ring form. The lower end thereof, a cap 325 nearly in a ring form is fixed by screwing. The cap 324 has a ring-formed recess formed in a top surface thereof. A ball bearing 3241 is arranged in the recess. An operation rod 34 generally in a cylinder form is rotatably inserted through the cap 324 and ball bearing 3241.

The other wing plate 33 is integrally provided with a cylindrical part 332 generally in a circular cylindrical form. Within the cylindrical part 332, fixed is a rotation assist part 333 in a form a bottomed cylindrical form is inverted. Within the rotation assist part 333, the operation rod 34 at its upper portion is fixed to the rotation assist part 333, to allow the other wing plate 33 and operation rod 34 to rotate in one body in a fixed state. The rotation assist part 333 in part is at an inside of the ball bearing 3241. The rotation assist part 333 in its underside is supported by the balls of the ball bearing 3241. By rolling of the balls, rotation is assisted, for smooth rotation, in the wing plate 33, the cylindrical part 332, the rotation assist part 333 and the operation rod 34.

The operation rod 34 has a portion accommodated in the cylinder 322 formed with a male thread 341 having a larger diameter than the other point, in other portion than the lower end. The male thread 341 has a top surface abutting against a washer 3292 arranged beneath the cap 324 at the upper end of the cylinder 322. Also, the cap 325 at the lower end of the cylinder 322 is provided with an engaging part 3251 projecting upward and having generally a bottomed cylindrical form. The male thread 341 has an underside abutting against an upper surface of a support part 3251*a*, referred later, of the engaging part 3251. The operation rod 34 at its lower end is inserted in a support hole 3251*b* at an inside of the engaging part 3251, referred later. The operation rod 34 is rotatably supported in the hole 3251*b*.

Figure 13:
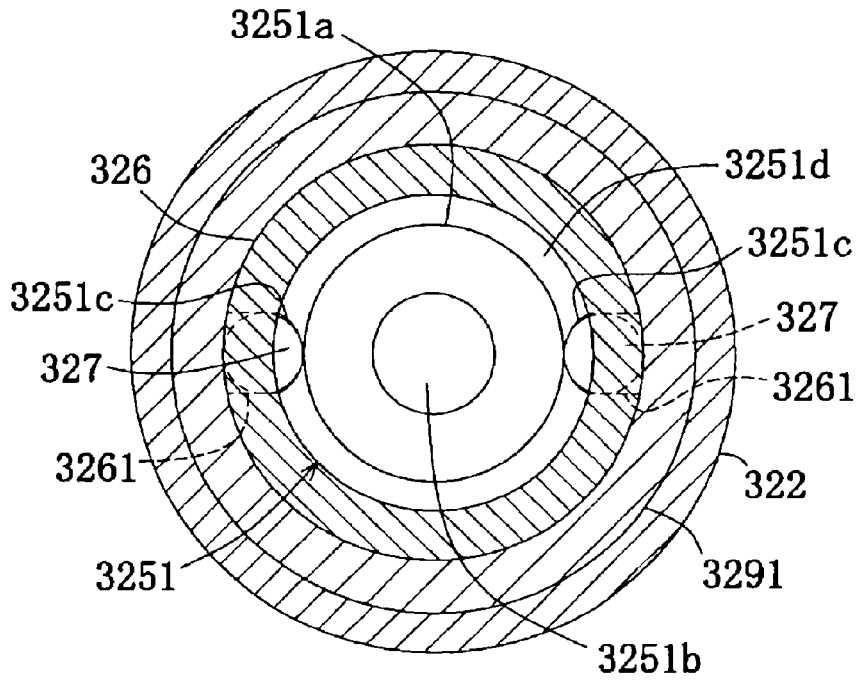
FIG. 13A is a cross sectional view on line Y—Y in FIG. 12.
FIG. 13B is a fragmentary longitudinal sectional view showing an engaging point between a cylindrical member and an engaging part in the hinge of FIG. 12.
Figure 13:
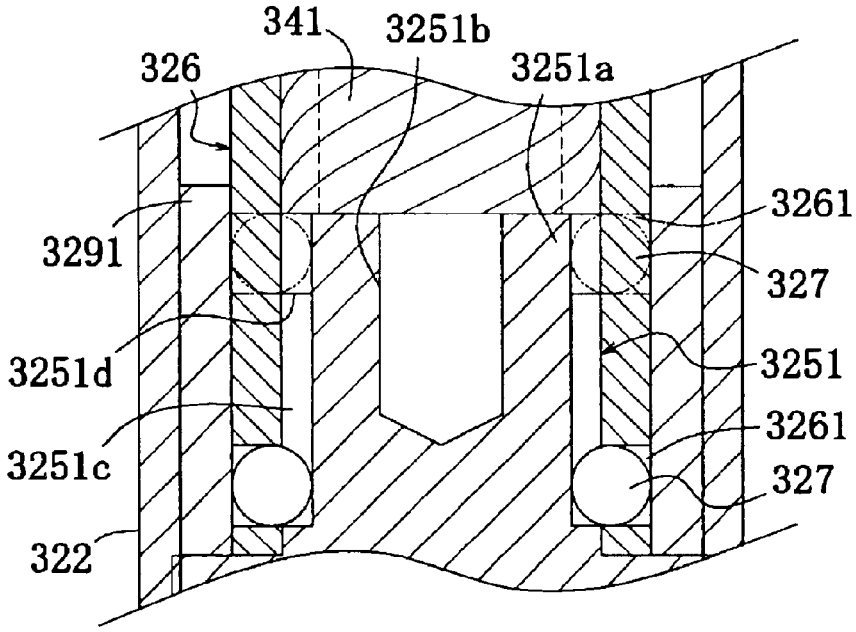

The cap 325, as shown in FIG. 13, has an upward-projecting engaging part 3251 generally in a bottomed cylindrical form formed on a base 3252 generally in a disk form. The base 3252 has a male thread formed in the upper portion of outer peripheral surface, in order for screwing to the female thread in the lower end of the cylinder 322. The outer periphery of the engaging part 3251 is slightly smaller in diameter than the outer periphery of the male thread 341. In the upper portion of the engaging part 3251, a support part 3251*a* is formed which is smaller in diameter than the engaging part 3251 and in a ring form. In an inside thereof, formed is a support hole 3251*b* nearly the same in shape as the lower end of the operation rod 34. Furthermore, in an outer surface of the engaging part 3251, two strips of recess grooves 3251*c*, in an arcuate form in plan view, are formed vertically extending. The recess groove 3251*c* is formed in an area of from a predetermined height of the engaging part 3251 to the upper surface 3251*d* of the engaging part 3251. The support part 3251*a* has an outer periphery formed nearly in the same position or somewhat inner of a deepest point of the recess groove 3251*c*, a height of which is nearly the same as the diameter of the hereinafter-referred sphere 327.

A cylinder member 326 is circumferentially provided over a generally lower end of the male thread 341 of the operation rod 34 and the engaging part 3251, as shown in FIGS. 12 and 13. The cylindrical member 326 is formed, in its inner peripheral surface, with female thread corresponding to the male thread 341. The male thread and the female thread are screwed together, to associate a rotation of the operation rod 34 or male thread 341 thereof with an ascend of the cylindrical member. The cylindrical member 326 has two penetration holes 3261 formed in opposite positions generally in the lower end thereof. Each penetration hole 3261 corresponds to the recess groove 3251*c* of the engaging part 3251. In each penetration hole 3261, a sphere 327 is arranged for rolling. On an outer side of the cylindrical member 326, circumferentially provided is an adjusting member 3291 in an cylindrical form having an inner diameter nearly equal to or slightly greater than the outer diameter of the cylindrical member 326. The spherical member 327 has a diameter greater than a peripheral wall thickness of the cylindrical member 326. The sphere 327 arranged in the penetration hole 3261, projecting in the corresponding recess groove 3251*c*, is allowed to move vertically along the recess groove 3251*c*. The engaging part 3251 or the recess groove 3251*c* thereof are indirectly engaged with the cylindrical member 326 through the sphere 327. Incidentally, the recess groove 3251*c*, the penetration groove 3261 and the sphere 327 are in a suitable number.

A washer 3293 is arranged on the upper end face of the cylindrical member 326 while a washer 3292 is arranged beneath the underside of the cap 324. A compression coiled spring 328 is arranged between the washer 3292 and the washer 3293. The compression coiled spring 328 is to be compressed by an ascend of the cylindrical member 326 associated with a rotation of the operation rod 34 upon opening the door. The restoration force thereof descends the cylindrical member 326, which causes a rotation in a direction closing the door of the operation rod 34 associated with the descending.

In the case of using the first example hinge 31*a* of the third embodiment, it is used in a set with another hinge to play a role of damping function during a door closing operation, e.g. the second example hinge 31*b* of the third embodiment to damp the impact upon closing the door by the hereinafter-referred action of air cushioning. One wing plate 32 of the hinge 31*a* is attached on a doorframe while the other wing plate 33 is on a door. Furthermore, the other hinge having a damping function is similarly attached, together with the one and the other wing plates, to the doorframe and door, thus structuring an automatic closing door mechanism having a damping function in door closing.

In the state the door having the hinge 31*a* is closed, the compression coiled spring 328 is decompressed to urge the cylindrical member 326 down. The cylindrical member 326, at its lower end face, positions at the top surface of the cap 325 base 3252 within the cylinder 322. On this occasion, the sphere 327 arranged for rolling in the penetration hole 3261 of the cylindrical member 326 projects in the recess groove 3251*c*, at nearly lower end of the recess groove 3251*c* of the engaging part 3251.

In response to the action to open the door, rotating the other wing plate 33 causes the operation rod 34 and male thread 341 to rotate circumferentially so that the cylindrical member 326 having, in its inner peripheral surface, a female thread screwed can ascend associatively with a rotation of the male thread 341. The cylindrical member 326 is not allowed to circumferentially rotate because the sphere 327 projects in and engages with the recess groove 3251*c* of the engaging part 3251. The sphere 327 moves up along the recess groove 3251*c* while being held in the penetration hole 3261 whereby the cylindrical member 326 moves up without rotation. In proportion to an ascend of the cylindrical member 326, the compression coiled spring 328 goes into compression.

Thereafter, as the cylindrical member 326 ascends to a predetermined height due to opening the door, the sphere 327 is released from the engagement with the recess groove 3251*c* that it projects in. As shown in FIG. 13, the sphere 327 held in the penetration hole 3261 projects in a ring-formed passage space surrounded by an engaging part 3251 upper surface 3251*d*, a support part 3251*a* outer peripheral surface, a male thread 341 lower end face and a cylindrical member 326 inner peripheral surface. For a rotation to open the door equal to or greater than a rotation angle corresponding to the predetermined height, by a rotation of the male thread 341, the sphere 327 projecting the passage space moves circumferentially to circumferentially rotate or race the cylindrical member 326. The cylindrical member 326 is kept at the predetermined height unless the sphere 327 goes into engagement with the recess groove 3251*c*. In a state the door is rotated beyond the rotation angle corresponding to the predetermined height, door opened state is maintained.

On the other hand, for a door rotation not reaching the rotation angle corresponding to the predetermined height, the sphere 327 stays in engagement with the recess groove 3251*c* without being released from the engagement into projection in the passage space. In case the artificial opening of the door is ended, the cylindrical member 326 is urged down by a restoration force of the compressed compression coiled spring 328. The sphere 327 projecting in the recess groove 3251*c* rolls down along the recess groove 3251*c*. In association with a descend of the cylindrical member 326, the male thread 341, the operation rod 34 and the other wing plate 33 rotate in a door closing direction, automatically effecting a door closing operation. In this case, in this example, the other hinge admits air in the cylinder during the door opening operation. During a door closing operation, the air within the cylinder is compressed by the piston to thereby flow it out while suppressing the amount of flowing out. Due to this, the door closing is moderated in motion by an action of air cushioning thereby damping impacts.

When the door in an opened state is rotated back to the rotation angle corresponding to the predetermined height by the artificial door closing operation, the sphere 327 projecting in the passage space is returned to engagement with the recess groove 3251*c*. Returning the sphere 327 to engagement with the recess groove 3251*c* is to be smoothly made because the cylindrical member 326 arranging the spheres 327 is urged down by the compressed compression coiled spring 328. By the return of the sphere 327 to engagement with the recess groove 3251*c*, the compression coiled spring 328 in a compressed state releases its restoration force. Decompressing the compression coiled spring 328 urges the cylindrical member 326 downward. While rolling down the sphere 327 projecting in the recess groove 3251*c* along the recess groove 3251*c*, the cylindrical member 326 moves down without rotation. Similarly to the foregoing, associatively with a descend of the cylindrical member 326, the male thread 341, the operation rod 34 and the other wing plate 33 rotate in the door closing direction, to automatically effect a door closing operation. The separate hinge having air-cushioning action acts to moderate the door closing motion and damp the impact.

Figure 14:
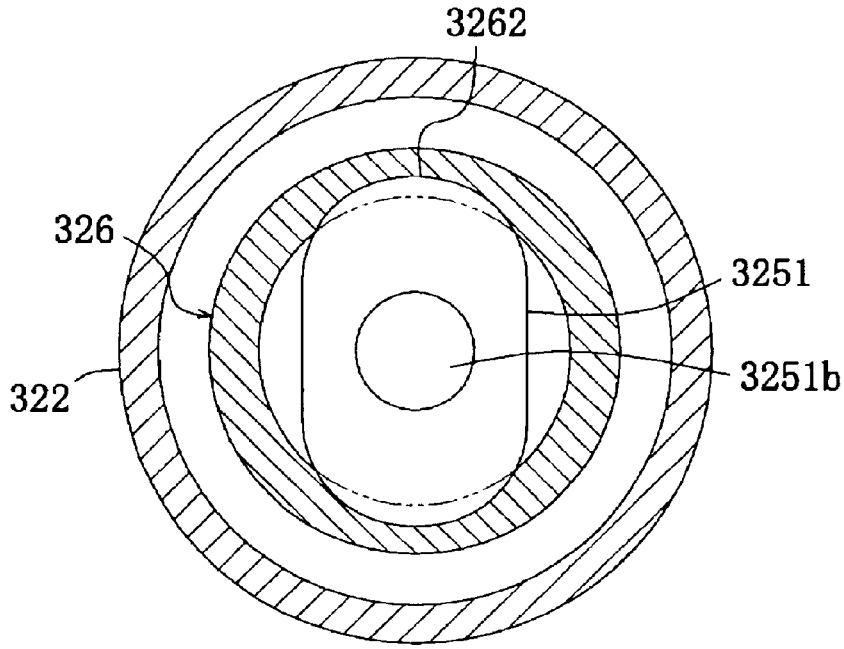
FIG. 14A is a cross sectional view of a modification corresponding to the arrow view on line Y—Y of FIG. 12.
FIG. 14B is a fragmentary longitudinal sectional view showing an engaging point between a cylindrical member and an engaging part in the modification.
Figure 14:
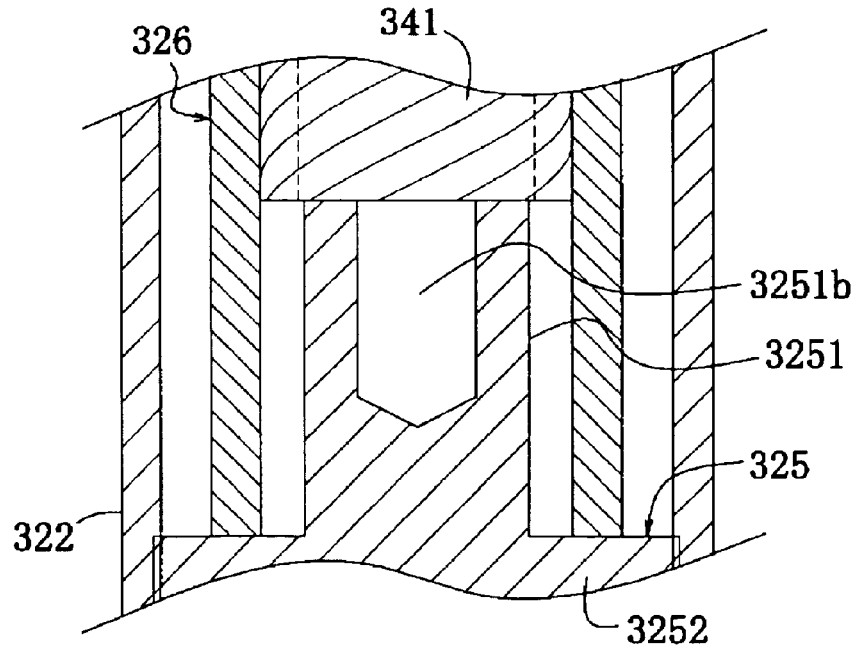

Meanwhile, the cylindrical member 326 and the engaging part 3251 can be placed in direct or indirect engagement, which engagement is in a suitable manner. The engagement is not limited to that through the sphere 327 as in the foregoing example, e.g. engagement may be as shown in the modification of FIG. 14. The cap 325 of FIG. 14 has an engaging part 3251, generally in a bottomed elliptic cylindrical form protruding upward to have a support hole 3251*b*, integrally formed on a base 3252 generally in a disk form male-threaded in an outer peripheral surface. The generally ellipse in plan view outer shape of the engaging part 3251 has a longer diameter formed longer than an inner diameter of the cylindrical member 326 and a shorter diameter formed shorter than the inner diameter of the cylindrical member 326. Meanwhile, similarly to the foregoing, the cylindrical member 326, at its inner surface, is female-threaded for screwing to the male thread on the male-thread part 341. In the opposed position of the inner surface, a fit grove 3262 is formed generally in the same form as the longer diameter portion to be fit by a longer diameter portion of the engaging part 3251. Fitting between the longer diameter portion of the engaging part 3251 and the fit groove 3262 places the engaging part 3251 and the cylindrical member 326 into engagement. Incidentally, the engaging part 3251 and fit groove 3262 may be suitably even a form other than an ellipse provided that non-circular in plan-view outer shape. It is suitably in a form having no corner, in order to smoothen fitting or engagement.

The hinge 31*a* with engagement in the modification is used in the similar way to the hinge 31*a* with engagement through the spheres 327, to structure an automatic closing door mechanism. In the hinge 31*a* of the modification in a state the door is closed, the cylindrical member 326 urged down by decompressing the compression coiled spring 328 has a lower end face positioned on the upper surface of the base 3252, thus fitting between the longer diameter portion of the engaging part 3251 and the fit groove 3262. In response to an operation to open the door, the operation rod 34 and its male thread 341 circumferentially rotates. In association with the rotation, the cylindrical member 326 ascends. The cylindrical member 326, while keeping a fit state between the longer diameter portion of the engaging part 3251 and the fit groove 3262, moves upward without circumferential rotation. As the cylindrical member 326 ascends, the compression coiled spring 328 is compressed.

Thereafter, when the cylindrical member 326 ascends to a predetermined height due to door opening operation, the longer diameter portion of the engaging part 3251 and the fit groove 3262 are placed out of and released from fitting. For a rotation of door opening greater than a rotation angle corresponding to the predetermined height, the cylindrical member 326 is circumferentially rotated or raced by rotation of the male thread 341. To the cylindrical member 326, the longer diameter portion of the engaging part 3251 is fit in the fit groove 3262 thereof. Unless the engagement between the engaging part 3251 and the cylindrical member 326 is not restored, the predetermined height is maintained. In a state the door is rotated greater than a rotation angle corresponding to the predetermined height, the door opened state is maintained.

On the other hand, for a door rotation not to reach a rotation angle corresponding to the predetermined height, the longer diameter portion of the engaging part 3251 and the fit groove 3262 do not go out of fitting. Maintained is the fitting between the longer diameter portion of the engaging part 3251 and the fit groove 3262 or the engagement between the engaging part 3251 and the cylindrical member 326. In case artificial door opening operation is ended, while maintaining the fitting between the longer diameter portion of the engaging part 3251 and the fit groove 3262, the cylindrical member 326 is urged downward and moved by a restoration force of the compressed compression coiled spring 328. In association with a descend of the cylindrical member 326, the male thread 341, the operation rod 34 and the other wing plate 33 rotates in the door closing direction, to automatically effect a door closing operation. On this occasion, similarly to the foregoing, the separate hinge acts to moderate the door closing operation through an action of air cushioning and damp impacts.

When the door in an opened state is rotated back to a rotation angle corresponding to the predetermined height by an artificial door closing operation, restored is the fitting between the longer diameter portion of the engaging part 3251 and the fit groove 3262 to thereby restore an engagement between the engaging part 3251 and the cylindrical member 326. The restoration is smoothly done by downwardly urging the cylindrical member 326 due to the compressed compression coiled spring 328. By restoring the fitting or engagement, a restoration force is released from the compressed compression coiled spring 328. By decompressing the compression coiled spring 328, the cylindrical member 326 is urged down. The cylindrical member 326 moves down without rotation while keeping the fit state between the longer diameter portion of the engaging part 3251 and the fit groove 3262. Similarly to the foregoing, door closing operation is automatically effected in association with a descend of the cylindrical member 326. Thus, the separate hinge having air-cushioning action acts to moderate door closing operation and damp impacts.

Figure 15:
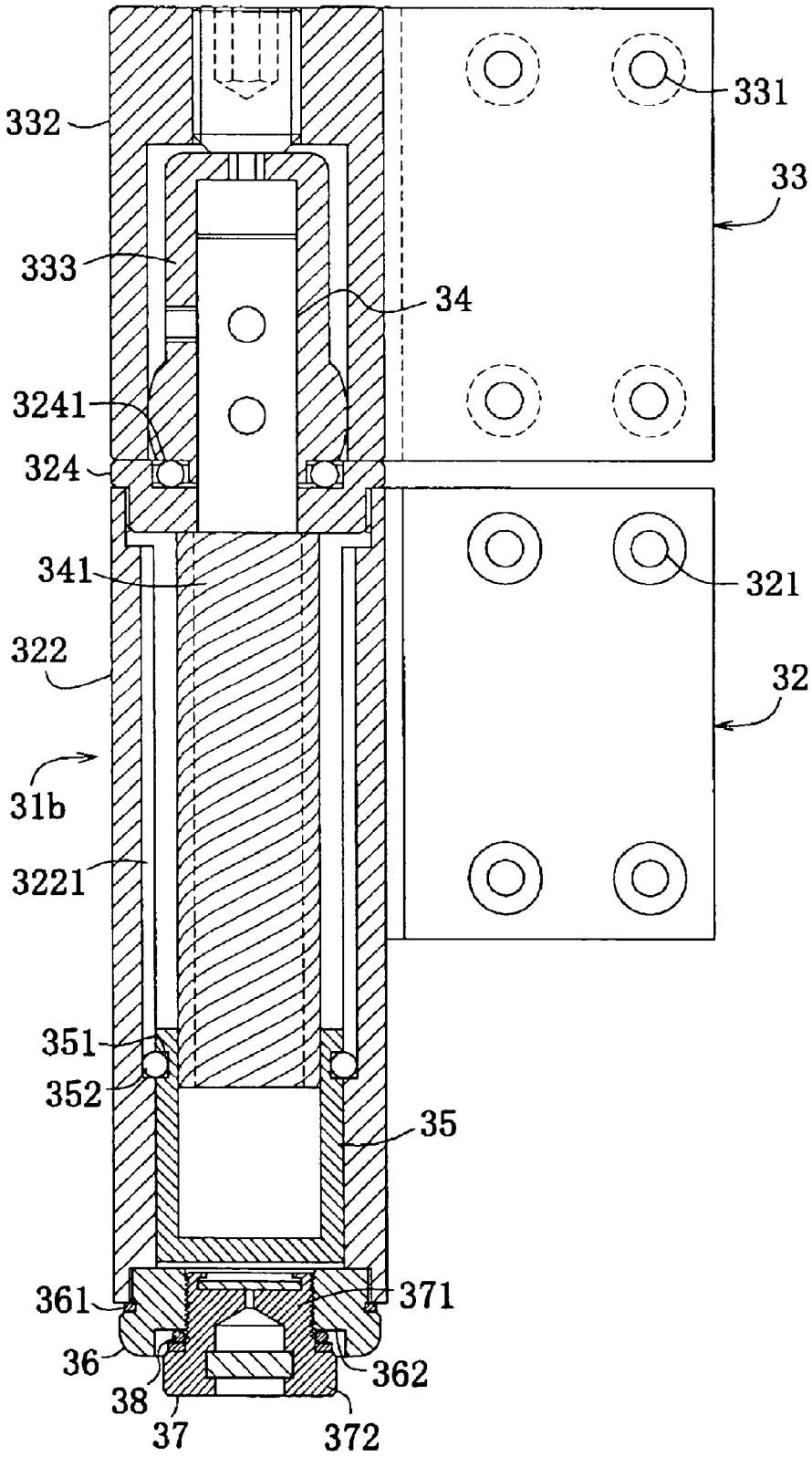
FIG. 15 is a longitudinal sectional view showing a second example in the third embodiment of the invention.

Now explained is a hinge 31*b* in a second example of the third embodiment of the invention. The second example hinge 31*b* of third embodiment shown in FIG. 15 does not accommodate a compression coiled spring 328 within a cylinder 322, which is a hinge having a role of damping function in door closing operation. For example, it is used in a set with a hinge having a role of automatic door closing function as in the first example hinge 31*a* of the third embodiment, to structure an automatic door closing function. Incidentally, the second example hinge 31*b* itself may be provided with a role of automatic door closing function by accommodating a compression coiled spring 328 within the cylinder 322. Meanwhile, the same structured element as the element of the first example hinge 31*a* of the third embodiment is attached with the same reference, to omit the explanation.

In the lower end of the operation rod 34 of the second example hinge 31*b* of the third embodiment, there is no downward projection from the male thread 341 as in the first example operation rod 34 of the third embodiment, i.e. the male thread 341 is provided down to its lower end. The male thread 341 is screwed with a piston 35 generally in a bottomed cylindrical form having a male thread in its inner peripheral surface. The piston 35 is arranged to slide vertically within the cylinder 322 associatively with a rotation of the operation rod 34 or its male thread 341. The piston 35 is formed with a plurality, e.g. two, of recesses 351 generally in an upper end thereof. Within the recesses 351, spheres 352 are respectively arranged for rolling. On the other hand, in the inner wall of the cylinder 322, a plurality, e.g. two, of strips of recess grooves 3221 are vertically formed correspondingly to the recesses 351. The sphere 352 partially projects in and engages with the recess 351 and recess grooves 321 so that the sphere 352 can roll along the recess groove 3221 while being held by the recess 351, thus smoothly sliding vertically within the cylinder 322 without rotating the piston 35.

Incidentally, the structure for associating between a rotation of the operation rod 34 and an ascend of the piston 35 without rotating the piston 35 may be suitably by a structure to make the piston 35 and the cylinder 322 inner wall the piston is to move vertically noncircular, e.g. square in plan view, a structure to fit between a convex strip or recess groove formed lengthwise in the outer periphery of the piston 35 and a recess groove or convex strip formed lengthwise in the inner wall of the cylinder 322, or the like.

Figure 16:
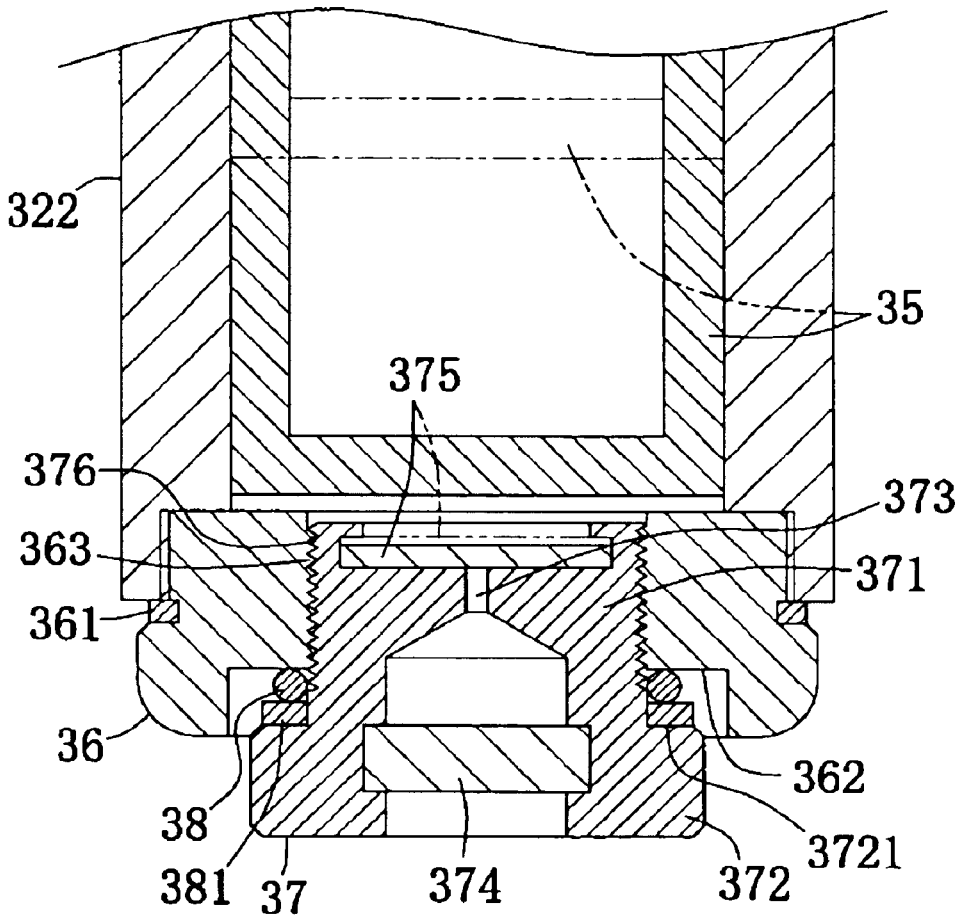
FIG. 16 is a fragmentary longitudinal sectional view showing valve means in the hinge of FIG. 15.

At the lower end of the cylinder 322, a cap 36 generally in a doughnut form is fixed by screwing the male thread of the outer periphery to the female thread of the lower-end inner periphery of the cylinder 322. An O-ring 361 is provided on the cap 36 at a lower end of the screwing portion thereof, to prevent the air flowing between the piston 35 and the cap 36 within the cylinder 322 from flowing out at the screwing portion thereby keeping air-tightness. As shown in FIG. 16, a female thread 363 is formed in the inner periphery of the cap 36. By screwing between the female thread 363 and the male thread 376 formed in an outer periphery thereof, an interior part 37 generally in a cylindrical form is attached at an inside of the cap 36.

The interior part 37 has an upper portion 371 smaller in diameter and a lower portion 372 larger in diameter. The interior part 37 is formed therein with an air flow-in port 373 tapered to have a reduced diameter. Below the air flow-in port 373, there is provided a filter 374 for preventing dusts. Above the air flow-in port 373, a valve plate 375 is rested so that the valve plate 375 can float under the reduced pressure within the cylinder 322 due to an ascend of the piston 35. The air, sucked at an air intake port in a lower end of the interior part 37, is admitted to the air flow-in port 373 through the filter 374. Passing a gap between the interior part 37 and the valve plate 375, air is allowed to enter the cylinder 322 at the upper end of the interior part 37.

At the lower end of screwed region of between the female thread 363 in the cap 36 inner periphery and the male thread 376 in the interior part 37 outer periphery, fit is an O-ring 38 having an inner diameter having the same diameter as the outer diameter of the upper part 371 of the interior part 37. Similarly, a washer 381 is fit under the O-ring 38. The O-ring 38 and the washer 381 are arranged between an inner lower surface of the cap 36 and a top surface 3721 of the lower part 372 of the interior part 37. By the above structure, during flowing out of air, the pressurization within the cylinder 322 due to a descend of the piston 35 urges the valve plate 375 against the air flow-in port 373 and closes it. Simultaneously, while suppressed in flow-out amount by the O-ring 38, air gradually flows out through a screw thread where the cap 36 and the interior part 37 are screwed together.

The flow-out amount of air through the screw thread varies depending upon a strength of screwing the interior part 37 to the cap 36, and a clamp strength by the cap 36 inner lower surface 362 and interior part 37 lower part 372 top surface 3721 onto the O-ring 38 and washer 381 depending upon the screwing strength. The air flow-out amount is adjusted to an optimal amount, to screw the interior part 37 to the cap 36 at a desired strength. Because the foregoing structure has the O-ring 38 for air-flow amount suppression at the outward of the screwing portion as a narrowest part in an air flow-out passage, air blockage can be prevented from occurring or reduced to a possible less extent. Should flowing-out air be blocked, the air flow-out amount can be adjusted to an optimal amount by merely loosening the screwing of the interior part 37. Air flow-out amount can be freely adjusted by tightening or loosening the screwing. Incidentally, the valve means for flowing air into the cylinder 322 and flowing air out of the cylinder 322 while suppressing flow-out amount is not limited to the above structure.

When using the first example hinge 31*b* of the third embodiment, it is used in a set with another hinge to play a role of automatic door closing function, e.g. the first example hinge 31*a* of the third embodiment. One wing plate 32 of the hinge 31*b* is attached on a doorframe while the other wing plate 33 is on a door. Furthermore, the other hinge having an automatic door closing function is similarly attached at the one and the other wing plate to the doorframe and door, thus structuring an automatic closing door mechanism having a damping function in door closing.

In the second example hinge 31*b* of the third embodiment in a state the door is closed, the piston 35 is in a lowermost position. In response to the action to open the door, by circumferentially rotating the other wing plate 33, the operation rod 34 and the male thread 341 thereof, the piston 35 ascends associatively with the rotation. The piston 35, because rolled along the recess groove 3221 while the sphere 352 is being held by the recess groove 3221, ascends without rotation within the cylinder 322. As the piston 35 ascends, the pressure is reduced at between the cap 36 and interior part 37 and the piston 35 within the cylinder 322. Due to pressure reduction, the valve plate 375 floats up (see FIG. 16), so that air is allowed to flow at the air flow-in port 373 to between the cap 36 and interior part 37 and the piston 35 within the cylinder 322, thus increasing or forming an air collection.

In case automatic door closing operation is effected by the separate hinge, e.g. by a restoration force of the compression coiled spring 328, the other wing plate 33, the operation rod 34 and the male thread 341 thereof of the hinge 31*b* circumferentially rotate reverse to that upon opening the door. In association with the rotation, the sphere 352 and the recess groove 3221 engages to descend the piston 35 without rotation. Although the air within the cylinder 322 flows out in the course of descend of the piston 35, the air flow-out passage as a screwing region between the cap 36 and the interior part 37 is blocked by an O-ring 38, to allow a proper amount of flowing out. Thus, air flow-out rate is suppressed to a desired amount. The piston 35 descends while compressing and gradually flowing out the air of the air collection, to exhibit an action of air cushioning due to the air flow out with suppression. The automatic door closing operation is moderately effected in motion by the separate hinge, thus damping the impact upon door closing. Finally, by closing the door, the piston 35 is again descended to the lowermost end within the cylinder 322, decreasing or vanishing the air collection in the cylinder 322.

Incidentally, the various parts of the hinge 31*a*, 31*b* can employ proper ones of materials and the like. For example, although the cylindrical member 326 or piston 35 may adopt a metal as a material, a resin such as a reinforced resin, if adopted, provides a high strength of hinge 31*a*, 31*b*, cylindrical member 326 and piston 35 while suitably reducing the weight thereof.

Meanwhile, the automatic closing door mechanism of the invention uses, as a set, a hinge having a role of automatic door closing function and a hinge having a role of damping function during door closing. Otherwise, used is a hinge having both an automatic door closing function and a damping function during door closing. The latter hinge can be structured into hinges respectively having both an automatic door closing function and a damping function during door closing. Further, the number of the hinges to be used may be decided arbitrarily.

What is claimed is:

1. An automatic closing door mechanism having a hinge having a pair of wing plates one of which has a cylinder in a circular cylindrical form received therein a piston, the other wing plate fixing an upper portion of an operation rod engaged with the piston, the piston being to be advanced and retracted through the operation rod associatively with a rotation of the other wing plate, the automatic closing door mechanism comprising:

a cam formed on the piston;

an engaging part provided in the operation rod and movable in the cam, the cam and the engaging part engaging between the piston and the operation rod;

a sphere arranged in a recess formed in an outer surface of the piston; and a recess groove formed lengthwise in the cylinder;

whereby the sphere rolls along the recess groove, to allow the piston to slide within the cylinder, impact upon door closing is to be damped by an action of air cushioning within the cylinder due to a return movement of the piston.

2. An automatic closing door mechanism according to claim 1, wherein the engaging part has a roller to rotate along the cam.

3. An automatic closing door mechanism according to claim 1, wherein the engaging part has a sphere arranged for rolling in a recess provided in an outer surface of the operation rod.

4. An automatic closing door mechanism according to claim 1, 2 or 3, further comprising another hinge having a piston received in a cylinder in a circular cylindrical form provided in one of a pair of wing plates, the other wing plate fixing an upper portion of an operation rod engaged with the piston, the piston being to be advanced and retracted through the operation rod associatively with a rotation of the other wing plate, the other hinge having a compression coiled spring arranged within the cylinder and to be compressed by an operation of the piston during door opening, the other wing plate being to be rotated in association with a return movement of the piston due to a return force of the compression coiled spring.

5. An automatic closing door mechanism having a hinge having a pair of wing plates one of which has a cylinder in a circular cylindrical form received therein a piston, the other wing plate fixing an upper portion of an operation rod engaged with the piston, the piston being to be advanced and retracted through the operation rod associatively with a rotation of the other wing plate, the automatic closing door mechanism comprising:

a female thread formed on the piston;

a male thread formed on the operation rod, the female and male threads engaging between the piston and the operation rod;

a sphere arranged in a recess formed in an outer surface of the piston;

a recess groove formed lengthwise in the cylinder, the sphere rolling along the recess groove, to allow the piston to slide within the cylinder; and a compression coiled spring arranged within the cylinder and to be compressed by an operation of the piston during door opening, the other wing plate being rotated in a direction toward door closing associatively with a return movement of the piston due to a restoration force of the compression coiled spring;

whereby impact upon door closing is to be damped by an action of air cushioning within the cylinder due to a return movement of the piston.

6. An automatic closing door mechanism according to claim 1, 2, 3, or 5, wherein a cap provided at a lower end of the cylinder has valve means for flowing air from the external to the cylinder and from the cylinder to the external, a flowing-out speed of air from the cylinder of the valve means being lower than a flowing-in speed of air to the cylinder of the valve, the valve means being capable of adjusting the flowing-out speed of air.

7. An automatic closing door mechanism having a damping function having a hinge comprising:

a pair of wing plates;

a piston arranged within a cylinder provided in one of the wing plates;

an operation rod fixed at a substantially upper portion by the other wing plate, a substantially lower portion of the operation rod being arranged within the cylinder;

a cam groove having a slant region formed in an outer periphery of the substantially lower portion of the operation rod; and a sphere or a roller arranged for rolling in a predetermined position of the piston and protruding in an inner periphery;

whereby the piston advances and retracts correspondingly to a movement of the sphere or the roller relative to the slant region of the cam groove, impact being to be damped by an action of air cushioning within the cylinder due to a return movement of the piston during door closing;

another hinge having a pair of wing plates, a piston arranged within a cylinder provided in one of the wing plates, an operation rod fixed at a substantially upper portion by the other wing plate, the piston being engaged with a substantially lower portion of the operation rod, the piston being to be advanced and retracted through the operation rod associatively with a rotation of the other wing plate, wherein a spring is arranged within the cylinder of the other hinge and to be compressed by an operation of the piston during door opening, the other wing plate being rotated in a direction toward door closing associatively with a return movement of the piston due to a restoration force of the spring.

8. An automatic closing door mechanism having a damping function according to claim 9, wherein the hinge or the other hinge is formed with a recess groove lengthwise in the cylinder, a second sphere being arranged for rolling in a predetermined position of the piston and protruding in an outer periphery, the second sphere rolling along the recess groove whereby the piston slides within the cylinder.

9. An automatic closing door mechanism having a damping function according to claim 8, wherein the hinge or the other hinge is formed with a second recess groove connected to the recess groove circumferentially in a predetermined position of the cylinder, the piston being placed into a halt state in advancement and retraction by an engagement of the second sphere with the second recess groove.

10. A hinge for use in an automatic closing door mechanism having a damping function due to air cushioning action, the hinge comprising:

a pair of wing plates;

a piston arranged within a cylinder provided in one of the wing plates;

an operation rod fixed at a substantially upper portion by the other wing plate, the piston being engaged with a substantially lower portion of the operation rod, the piston being to be advanced and retracted through the operation rod associatively with a rotation of the other wing plate; and a sphere arranged for rolling in a predetermined position of the piston and protruding in an outer periphery;

whereby the piston slides within the cylinder by rolling the sphere along a recess groove formed lengthwise in the cylinder.

11. A hinge according to claim 10, further comprising a spring arranged within the cylinder and to be compressed by an operation of the piston during door opening, the other wing plate being to be rotated in a direction toward door closing associatively with a return movement of the piston due to a restoration force of the spring, wherein a second recess groove is formed connected to the recess groove circumferentially in a predetermined position of the cylinder, the piston being to be placed into a halt state in advancement and retraction by an engagement of the sphere with the second recess groove.

12. A hinge for in an automatic closing door mechanism having a damping function due to air cushioning action, the hinge comprising:

a pair of wing plates;

a piston arranged within a cylinder provided in one of the wing plates;

an operation rod fixed at a substantially upper portion by the other wing plate, the piston being engaged with a substantially lower portion of the operation rod, rotation of the other wing plate and advancement and retraction of the piston being associated through the operation rod; and wherein the cylinder has a circular cross sectional form, having at least one protrusions protruding from the circular cross sectional form, wherein the at least one protrusions are provided along a lengthwise direction in the cylinder, a sphere arranged for rolling in a predetermined position of the piston and protruding in an outer periphery, the piston being to be slid within the cylinder by rolling the sphere along the at least one of the protrusions.

13. An automatic closing door hinge having a pair of wing plates, a cylindrical member substantially in a cylindrical form arranged within a cylinder provided in one of the wing plates, an operation rod fixed at a substantially upper portion by the other wing plate, the cylindrical member being engaged with a substantially lower portion of the operation rod, a rotation of the other wing plate and an ascend and descend of the cylindrical member being associated through the operation rod, and a spring arranged within the cylinder and to be compressed by an ascend of the cylindrical member during door opening thereby rotating the other wing plate in a direction toward door closing associatively with a descend of the cylindrical member due to a restoration force of the spring, the automatic door closing hinge characterized in that:

an engaging part provided inward of the cylindrical member and substantially below the operation rod is engaged with the cylindrical member, the cylindrical member when ascending to a predetermined height being released from the engagement with the engaging part and halts ascending, the cylindrical member positioned at the predetermined height being engaged with the engaging part whereby the cylindrical member commence descending due to a restoration force of the spring;

wherein the engaging part is in a substantially columnar form or substantially bottomed cylindrical form formed with a vertically extending recess groove, the cylindrical member being formed with a recess recessed in an inner peripheral surface or penetration hole, a sphere arranged for rolling in the recess or penetration hole being to engage with the recess groove thereby engaging between the engaging part and cylindrical member.

14. An automatic closing door hinge having a pair of wing plates, a cylindrical member substantially in a cylindrical form arranged within a cylinder provided in one of the wing plates, an operation rod fixed at a substantially upper portion by the other wing plate, the cylindrical member being engaged with a substantially lower portion of the operation rod, a rotation of the other wing plate and an ascend and descend of the cylindrical member being associated through the operation rod, and a spring arranged within the cylinder and to be compressed by an ascend of the cylindrical member during door opening thereby rotating the other wing plate in a direction toward door closing associatively with a descend of the cylindrical member due to a restoration force of the spring, the automatic door closing hinge characterized in that:

an engaging part provided inward of the cylindrical member and substantially below the operation rod is engaged with the cylindrical member, the cylindrical member when ascending to a predetermined height being released from the engagement with the engaging part and halts ascending, the cylindrical member positioned at the predetermined height being engaged with the engaging part whereby the cylindrical member commences descending due to a restoration force of the spring;

wherein the engaging part has an outer shape in plan view of a non-circular substantially columnar or substantially bottomed cylindrical form and formed with a fit groove vertically extending from a lower end in an inner surface of the cylindrical member, the engaging part and the cylindrical member is to be engaged by fitting between the engaging part and the fit groove.

15. An automatic closing door hinge according to claim 13 or 14, wherein the cylindrical member can form a substantially airtight space within the cylinder, impact being to be damped during door closing by an action of air cushioning within the cylinder due to a descend of the cylindrical member.

16. An automatic closing door mechanism comprising a first hinge structured with:

a pair of wing plates;

a cylindrical member arranged within a cylinder provided in one of the wing plates;

an operation rod fixed at a substantially upper portion by the other wing plate, the cylindrical member being engaged with a substantially lower portion of the operation rod, a rotation of the other wing plate and an ascend and descend of the cylindrical member being associated through the operation rod;

a spring arranged within the cylinder and to be compressed by an ascend of the cylindrical member during door opening, the other wing plate being to be rotated in a direction toward door closing associatively with a descend of the cylindrical member due to a restoration force of the spring; and an engaging part provided inward of the cylindrical member and beneath the operation rod, the engaging part being to be engaged with the cylindrical member, the cylindrical member when ascended to a predetermined height being released from the engagement of the engaging part and stopped ascending, the cylindrical member positioned in a predetermined height being engaged by the engaging part whereby the cylindrical member begins descending due to a restoration force of the spring; and a second hinge structured with:

a pair of wing plates;

a cylinder provided on one of the wing plates;

a piston arranged within the cylinder; and an operation rod fixed at a substantially upper portion by the other wing plate, the piston being engaged with a substantially lower portion of the operation rod;

whereby a rotation of the other wing plate and an ascend and descend of the piston is associated through the operation rod, impact being to be damped during door closing by an action of air cushioning due to a descend of the piston.

17. A hinge of an automatic closing door mechanism comprising:

a pair of wing plates;

a cylinder provided in one of the wing plates;

a piston arranged within the cylinder; and an operation rod fixed at a substantially upper portion by the other wing plate, the piston being engaged with a substantially lower portion of the operation rod, a rotation of the other wing plate and an ascend and descend of the piston being associated through the operation rod, impact being to be damped during door closing by an action of air cushioning due to a descend of the piston;

wherein an O-ring as a flow-out suppressing member is provided at outward of a gap of a screw thread screwed as a narrowest portion of a flow-out passage of the cylinder.

18. A hinge for use in an automatic closing door mechanism having a damping function, the hinge comprising:

a pair of wing plates;

a piston arranged within a cylinder provided in one of the wing plates;

an operation rod fixed at a substantially upper portion by the other wing plate, a substantially lower portion of the operation rod being arranged within the cylinder;

a cam groove having a slant region formed in an outer periphery of the substantially lower portion of the operation rod; and a sphere or a roller arranged for rolling in a predetermined position of the piston and protruding in an inner periphery, whereby the piston advances and retracts correspondingly to a movement of the sphere or the roller relative to the slant region of the cam groove, impact being to be damped by an action of air cushioning within the cylinder due to a return movement of the piston during door closing, wherein the hinge has one end of the cam groove and a vicinity thereof formed substantially horizontal, a door opened state being to be maintained by positioning the sphere or the roller in a substantially horizontal region.

19. A hinge according to claim 18, wherein the hinge has a slant in the slant region of the cam groove gradually moderating toward a direction of movement of the piston.

20. A hinge for use in an automatic closing door mechanism having a damping function, the hinge comprising:

a pair of wing plates;

a piston arranged within a cylinder provided in one of the wing plates;

an operation rod fixed at a substantially upper portion by the other wing plate, a substantially lower portion of the operation rod being arranged within the cylinder;

a cam groove having a slant region formed in an outer periphery of the substantially lower portion of the operation rod; and a sphere or a roller arranged for rolling in a predetermined position of the piston and protruding in an inner periphery, whereby the piston advances and retracts correspondingly to a movement of the sphere or the roller relative to the slant region of the cam groove, impact being to be damped by an action of air cushioning within the cylinder due to a return movement of the piston during door closing, wherein the hinge has a slant in the slant region of the cam groove gradually moderating toward a direction of movement of the piston.

21. A hinge for use in an automatic closing door mechanism having a damping function, the hinge comprising:

a pair of wing plates;

a piston arranged within a cylinder provided in one of the wing plates;

an operation rod fixed at a substantially upper portion by the other wing plate, a substantially lower portion of the operation rod being arranged within the cylinder;

a cam groove having a slant region formed in an outer periphery of the substantially lower portion of the operation rod; and a sphere or a roller arranged for rolling in a predetermined position of the piston and protruding in an inner periphery, whereby the piston advances and retracts correspondingly to a movement of the sphere or the roller relative to the slant region of the cam groove, impact being to be damped by an action of air cushioning within the cylinder due to a return movement of the piston during door closing, wherein the hinge has two sets or more of the cam grooves and the spheres or the rollers engaging the cam grooves.

22. An automatic closing door mechanism having a damping function comprising a first hinge structured with:

a pair of wing plates;

a piston arranged within a cylinder provided in one of the wing plates;

an operation rod fixed at a substantially upper portion by the other wing plate, a substantially lower portion of the operation rod being arranged within the cylinder;

a cam groove having a slant region formed in an outer periphery of the substantially lower portion of the operation rod; and a sphere or a roller arranged for rolling in a predetermined position of the piston and protruding in an inner periphery;

whereby the piston advances and retracts correspondingly to a movement of the sphere or the roller relative to the slant region of the cam groove, wherein the hinge has one end of the cam groove and a vicinity thereof formed substantially horizontal, a door opened state being to be maintained by positioning the sphere or the roller in a substantially horizontal region, and a second hinge structured with:

a pair of wing plates;

a piston arranged within a cylinder provided in one of the wing plates; and an operation rod fixed at a substantially upper portion by the other wing plate, the piston being engaged with a substantially lower portion of the operation rod;

whereby a rotation of the other wing plate and an advancement and retraction of the piston is associated through the operation rod, impact being to be damped during door closing by an action of air cushioning due to a return movement of the piston.

23. An automatic closing door mechanism according to claim 22, wherein the first hinge has a slant in the slant region of the cam groove gradually moderating toward a direction of movement of the piston.

24. An automatic closing door mechanism having a damping function comprising a first hinge structured with:

a pair of wing plates;

a piston arranged within a cylinder provided in one of the wing plates;

an operation rod fixed at a substantially upper portion by the other wing plate, a substantially lower portion of the operation rod being arranged within the cylinder;

a cam groove having a slant region formed in an outer periphery of the substantially lower portion of the operation rod; and a sphere or a roller arranged for rolling in a predetermined position of the piston and protruding in an inner periphery;

whereby the piston advances and retracts correspondingly to a movement of the sphere or the roller relative to the slant region of the cam groove, wherein the hinge has a slant in the slant region of the cam groove gradually moderating toward a direction of movement of the piston, and a second hinge structured with:

a pair of wing plates;

a piston arranged within a cylinder provided in one of the wing plates; and an operation rod fixed at a substantially upper portion by the other wing plate, the piston being engaged with a substantially lower portion of the operation rod;

whereby a rotation of the other wing plate and an advancement and retraction of the piston is associated through the operation rod, impact being to be damped during door closing by an action of air cushioning due to a return movement of the piston.

25. An automatic closing door mechanism having a damping function comprising a first hinge structured with:

a pair of wing plates;

a piston arranged within a cylinder provided in one of the wing plates;

an operation rod fixed at a substantially upper portion by the other wing plate, a substantially lower portion of the operation rod being arranged within the cylinder;

a cam groove having a slant region formed in an outer periphery of the substantially lower portion of the operation rod; and a sphere or a roller arranged for rolling in a predetermined position of the piston and protruding in an inner periphery;

whereby the piston advances and retracts correspondingly to a movement of the sphere or the roller relative to the slant region of the cam groove, wherein the hinge has two sets or more of the cam grooves and the spheres or the rollers engaging the cam grooves, and a second hinge structured with:

a pair of wing plates;

a piston arranged within a cylinder provided in one of the wing plates; and an operation rod fixed at a substantially upper portion by the other wing plate, the piston being engaged with a substantially lower portion of the operation rod;

whereby a rotation of the other wing plate and an advancement and retraction of the piston is associated through the operation rod, impact being to be damped during door closing by an action of air cushioning due to a return movement of the piston.

* * * * *